US011634872B2

(12) United States Patent
Coats et al.

(10) Patent No.: US 11,634,872 B2
(45) Date of Patent: Apr. 25, 2023

(54) TRANSPARENT RAILROAD RAILSEAT ASSEMBLY

(71) Applicant: Pandrol Limited, Surrey (GB)

(72) Inventors: Frank Howard Coats, Thorofare, NJ (US); Pelle Nghi Duong, Garnet Valley, PA (US)

(73) Assignee: PANDROL LIMITED, Surrey (GB)

( * ) Notice: Subject to any disclaimer, the term of this patent is extended or adjusted under 35 U.S.C. 154(b) by 495 days.

(21) Appl. No.: 16/583,874

(22) Filed: Sep. 26, 2019

(65) Prior Publication Data

US 2020/0102706 A1 Apr. 2, 2020

Related U.S. Application Data

(60) Provisional application No. 62/739,649, filed on Oct. 1, 2018.

(51) Int. Cl.

| | |
|---|---|
| ***E01B 9/42*** | (2006.01) |
| ***E01B 29/04*** | (2006.01) |
| ***E01B 9/48*** | (2006.01) |

(52) U.S. Cl.
CPC ..... *E01B 9/42* (2013.01); *E01B 9/483* (2013.01); *E01B 29/04* (2013.01)

(58) Field of Classification Search
CPC ..... E01B 9/42; E01B 9/483; E01B 29/04
See application file for complete search history.

(56) References Cited

U.S. PATENT DOCUMENTS

| | | | | |
|---|---|---|---|---|
| 3,581,990 | A | 6/1971 | Kirik | |
| 4,618,093 | A | 10/1986 | Young et al. | |
| 5,110,046 | A | 5/1992 | Young | |
| 5,404,081 | A | 4/1995 | Kane et al. | |
| 5,549,245 | A | 8/1996 | Kish | |
| 5,551,663 | A | 9/1996 | Kish et al. | |
| 7,080,791 | B2 | 7/2006 | Geissele et al. | |
| 9,103,074 | B1 * | 8/2015 | Urmson, Jr. | E01B 9/42 |
| 2002/0070283 | A1 | 6/2002 | Young | |
| 2004/0113133 | A1 * | 6/2004 | Geissele | E01B 9/68 254/43 |

(Continued)

FOREIGN PATENT DOCUMENTS

| | | |
|---|---|---|
| EP | 0825300 | 2/1998 |
| JP | 3936343 | 6/2007 |
| JP | 2011174299 | 9/2011 |

(Continued)

OTHER PUBLICATIONS

International Search Report and Written Opinion, US Patent and Trademark Office, Application No. PCT/US2019/053280, dated Feb. 28, 2020.

(Continued)

*Primary Examiner* — Robert J McGarry, Jr.

(74) *Attorney, Agent, or Firm* — Gottlieb, Rackman & Reisman, PC

(57) ABSTRACT

A railroad fastening system that includes a see-thru (transparent or translucent) rail seat assembly which allows for immediate visual feedback to assess whether that a sufficient amount of adhesive material has been applied to a crosstie during the installation of a rail seat assembly on a crosstie to ensure a long-lasting bond and a proper cant, flatness and height of a rail seat assembly.

9 Claims, 27 Drawing Sheets

(56) References Cited

U.S. PATENT DOCUMENTS

| | | | |
|---|---|---|---|
| 2008/0093472 | A1 | 4/2008 | Hohne et al. |
| 2014/0371373 | A1 | 12/2014 | Harrass et al. |

FOREIGN PATENT DOCUMENTS

| | | | | |
|---|---|---|---|---|
| KR | 101043191 | | 6/2011 | |
| KR | 101630788 | | 6/2015 | |
| KR | 20150109627 | | 10/2015 | |
| KR | 101630788 | B1 * | 6/2016 | ..... E01B 9/68 |
| WO | 2011032969 | | 3/2011 | |

OTHER PUBLICATIONS

A&K Railroad Materials, Inc., http://www.akrailroad.com/products/track-accessories, Sep. 11, 2017.

* cited by examiner

TRANSPARENT RAILROAD RAILSEAT ASSEMBLY

CROSS-REFERENCE TO RELATED APPLICATION

This patent application claims benefit to U.S. Provisional Patent Application No. 62/739,649, filed Oct. 1, 2018, which is hereby incorporated by reference in its entirety as part of the present disclosure.

FIELD OF THE INVENTION

This patent application pertains generally to railroad systems and more specifically to a railroad fastening system that includes a see-thru (transparent or translucent) rail seat assembly which allows for immediate visual feedback to assess whether that a sufficient amount of adhesive material has been applied to a crosstie during the installation of a rail seat assembly on a crosstie to ensure a long-lasting bond and a proper cant, flatness and height of a rail seat assembly.

BACKGROUND OF THE INVENTION

Rails in railroad systems are conventionally mounted on tie plates that are arranged and constructed to hold the rails securely in place. Tie plates in turn are secured to crossties, which, for example, can be made of wood or concrete, using various means, including spikes and/or composite material.

Tie plates are included in a railroad system to increase bearing loads, aid in securing rails to a crosstie and to set cant of a rail. With wood crossties, over time, reverse roll cant of a rail can occur due to tie plate cutting. That is, the edge of a tie plate farthest from a rail can cut or dig into a crosstie and cause the cant, or gauge, of a rail to rotate in an undesirable direction. As a result of tie plate cutting, gauging issues can arise causing vertical loading on the rail to become improper and the rail seat can become weakened, which in turn can result in safety issues, such as rail rollover. Additionally, in many instances debris can work itself between a tie plate, tie pad and a crosstie so that the tie plate is no longer fixed securely to the crosstie. To address tie plate cutting, rails can be ground and/or the plate-bearing surface of a crosstie can be adzed to create a level surface on which the tie plate can then be remounted.

Grinding a rail only temporarily addresses reverse roll cant and adzing is a time consuming process that requires heavy machinery to be brought to the location of track where tie plate cutting occurred, which can be a difficult task in some instances and a very time consuming process.

The current repair application on concrete ties using an adhesive material such as epoxy, urethane or the like makes it difficult, if at all, to determine if a sufficient amount of adhesive material has been applied between a crosstie and rail seat assembly mounted on the crosstie. If too little adhesive material is applied to the rail seat assembly and crosstie, cavities can form between the rail seat assembly and the crosstie and the connection between rail seat assembly and the crosstie may become weakened causing the rail seat assembly to separate from the crosstie soon after the application of the adhesive material. Alternatively, if too much adhesive material is used, there can be an excessive amount of waste of material, which in turn results in an unnecessary expense, and can cause uneven (non-uniform or less uniform) loading and point loading in the rail seat. Additionally, current designs make it difficult to ensure proper rail height, flatness (for uniform loading) and cant when performing a repair. Thus, in many instances, poor life of a repaired rail systems or excessive waste of repair material can result by not knowing if the proper amount of epoxy has been used. Additionally, current methods of repair do not ensure a rail seat is repaired to the correct flatness (to avoid stress risers under the rail), cant (1:40) and height.

SUMMARY OF THE INVENTION

Broadly, the present disclosure is directed to a rail seat assembly that includes a tie pad and a tie plate that can be made of a transparent material so as to determine if a sufficient amount of adhesive material (e.g., urethane, epoxy, etc.) has been applied to a crosstie and a plate during an installation of a rail seat assembly on a crosstie. The transparency or translucency of the plate allows for immediate (at point of application) or at a later point in time (i.e., an inspector walking a segment of track) visual verification that the plate and associated crosstie has a sufficient amount of adhesive to ensure a long-lasting bond and that the cant, flatness and height of the rail seat assembly is proper.

The transparent rail seat assembly of the present disclosure allows for in-track repair, refurbish and reuse (and life extension) of crossties that are worn at the rail seat due to plate cutting, eliminates the need to utilize heavy equipment such as adzing machinery and does not require damaged crossties to be removed from a track for repair and/or replacement.

BRIEF DESCRIPTION OF THE DRAWINGS

The features of the present invention will become more apparent by describing in detail exemplary embodiments thereof in conjunction with the accompanying drawings, in which.

DETAILED DESCRIPTION OF EMBODIMENTS OF THE INVENTION

With reference now to the drawings, and in particular to FIGS. 1 through 12, embodiments of a rail seat assembly embodying the principles and concepts of the present invention will be described.

Figure 1A:
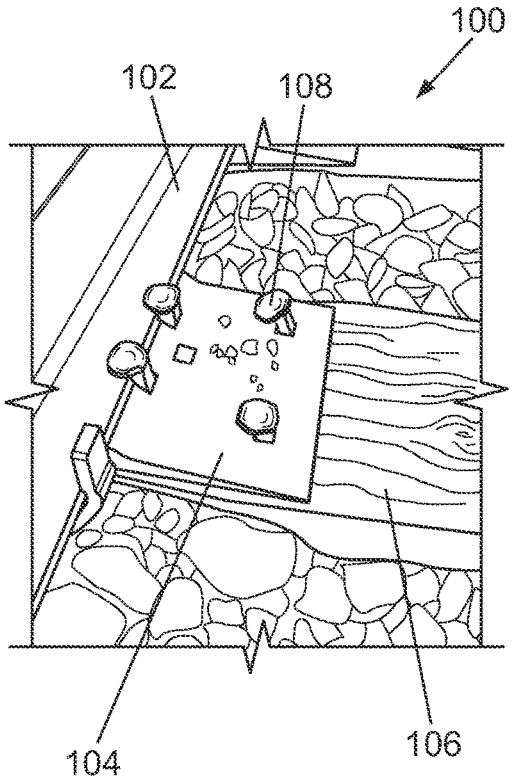
FIG. 1A is schematic view of a rail fastening system that includes a wooden crosstie and a steel tie plate where the tie plate has cut into the crosstie.

FIG. 1A illustrate a known rail seat assembly 100 that includes a rail 102 that is seated on a tie plate 104 that is secured to a crosstie 106 by spikes 108. As shown, the edge of a tie plate 104 farthest from the rail 102 is cutting or digging into the crosstie 106 causing a depression 107 which results in a reverse cant of the of the rail 102 and in turn an unsafe rail condition.

Figure 1B:
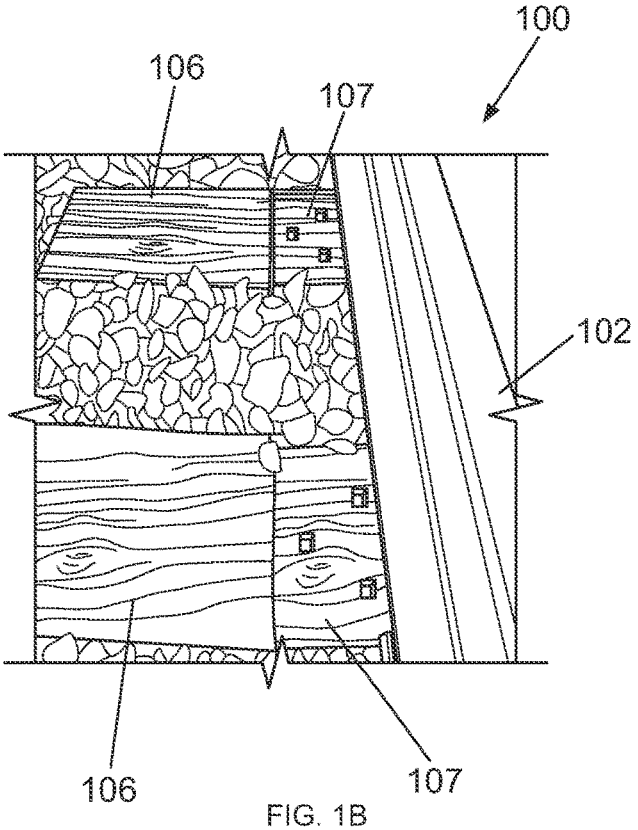
FIG. 1B is a schematic view of the rail fastening system of FIG. 1A showing damage to the crosstie as a result of tie plate cutting.

FIG. 1B shows the rail seat assembly 100 of FIG. 1 with the tie plate 104 removed to show the damage caused to the crosstie 106 at the depression 107 by the cutting of the tie plate 104 into the crosstie 106.

Figure 2A:
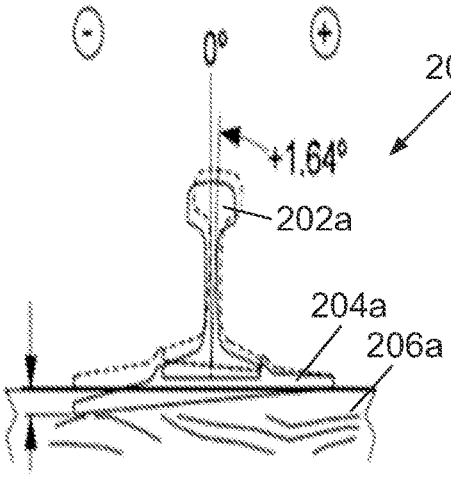
FIGS. 2A and 2B are cross-sectional views of railroad systems depicting reverse cant of a rail system and excessive cant of rail system, respectively.
Figure 2B:
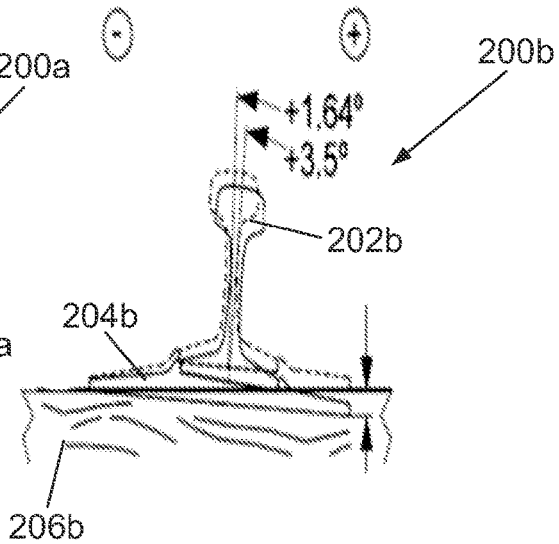

FIGS. 2A is a cross-sectional view that depicts a rail seat assembly 200*a* that includes a rail 202*a*, tie plate 204*a*, and a crosstie 206*a*, which has a reverse cant and FIG. 2B depicts a rail seat assembly 200*b* that includes a rail 202*b*, tie plate 204*b*, and a crosstie 206*b*, which has excess cant which can occur to a rail system as a result of tie plate cutting.

Figure 3:
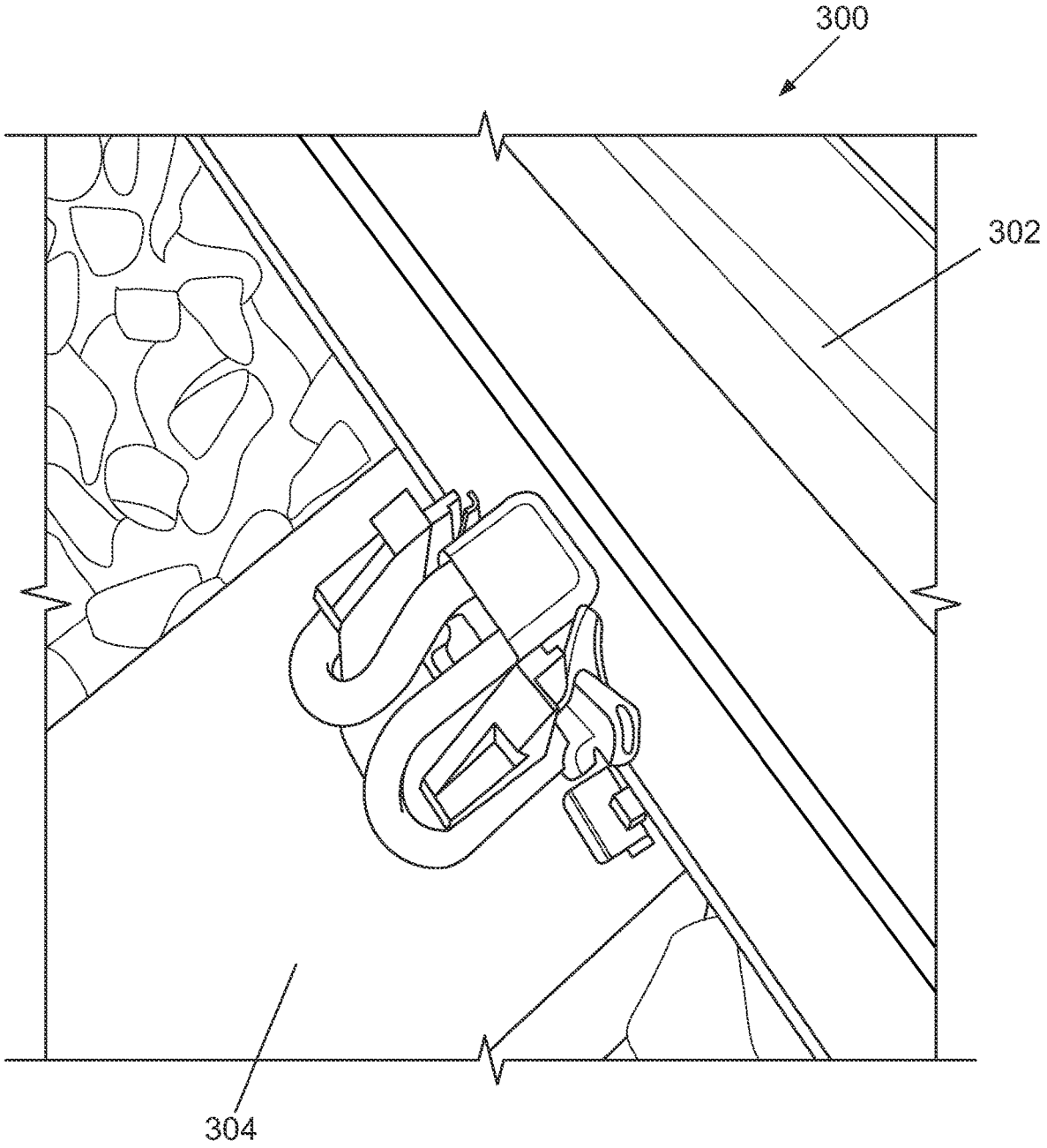
FIG. 3 is a schematic view of a rail seat assembly on a concreate crosstie.

FIG. 3 is a schematic view of an existing rail seat assembly 300 that is fixed on a concrete crosstie 306 with a rail 302 arranged on the assembly 300.

Figure 4A:
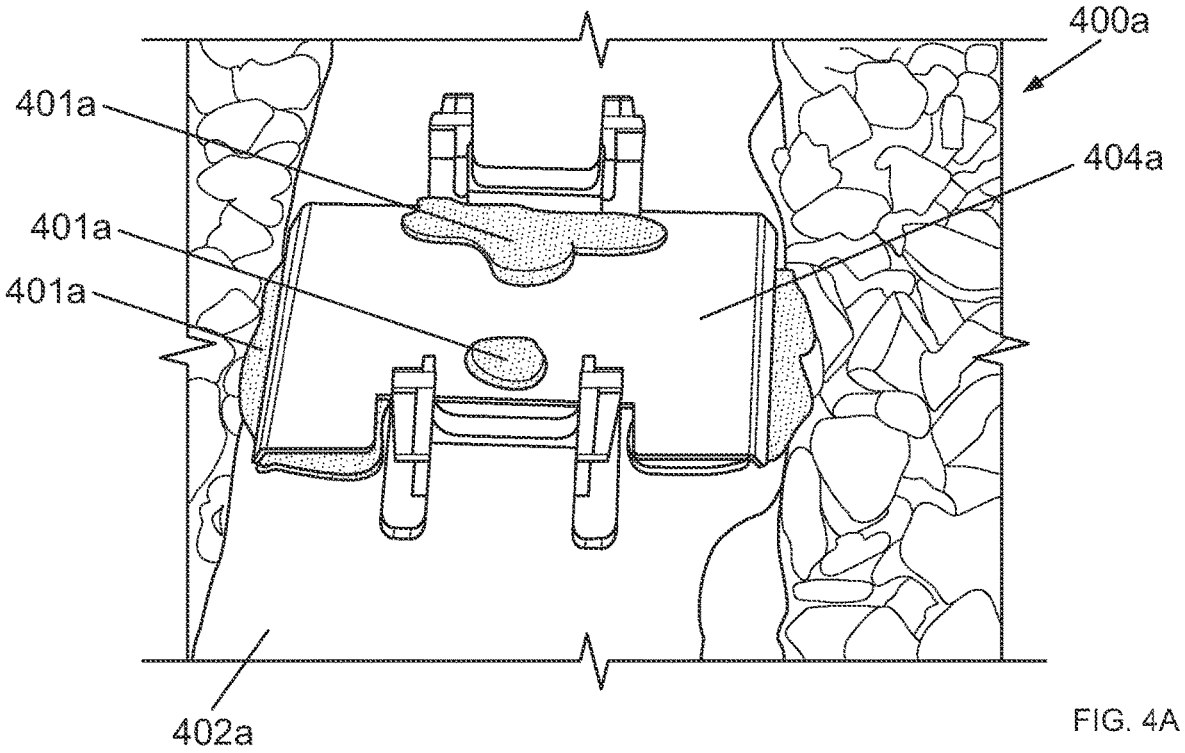
FIGS. 4A and 4B show known repair methods used to a replace a broken rail seat that uses one form of fasteners.
Figure 4B:
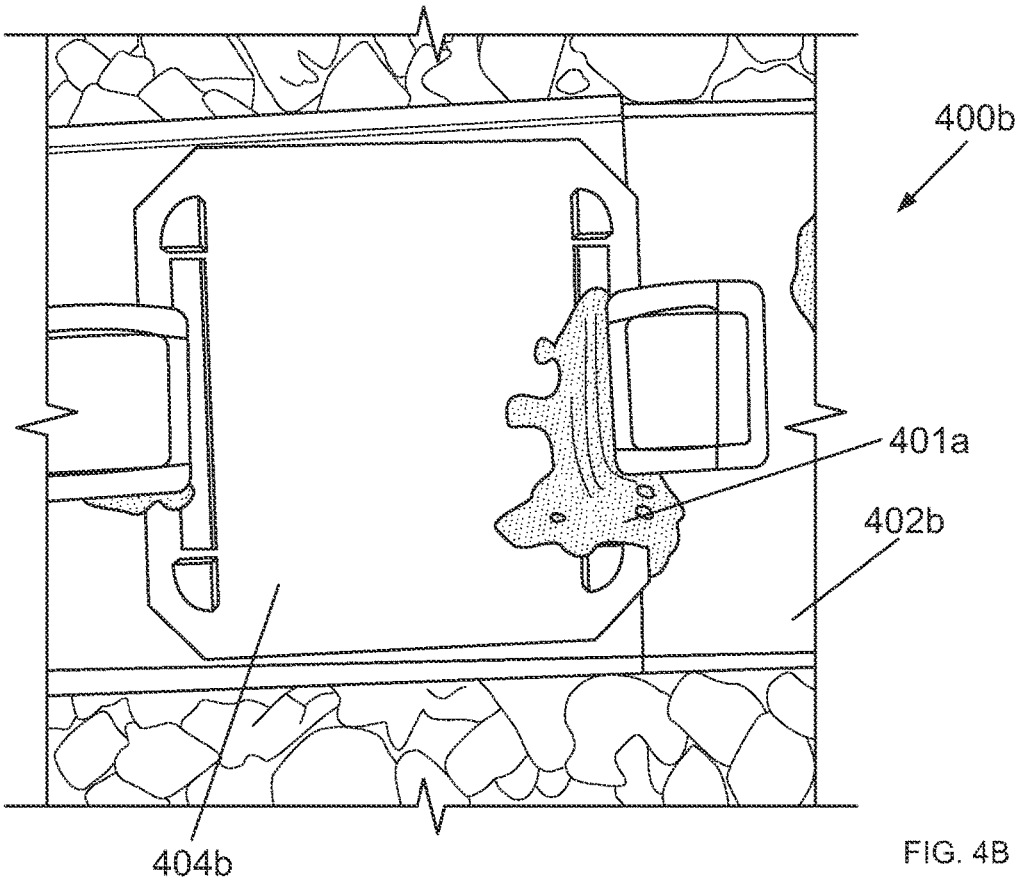

FIGS. 4A and 4B depict known methods used to repair rail seat assemblies. As shown in FIG. 4A, the rail seat assembly 400*a* includes an application of a layer of urethane 401*a* on a concrete crosstie 402*a* and a plate 404*a* arranged over the urethane 401*a*. As can be seen, an excessive amount of urethane 401 (i.e., waste) was placed on the crosstie 402*a* resulting in urethane 401*a* extending beyond the outer periphery of the plate 404 and through ports or openings 403 in the plate 504. FIG. 4B shows a rail seat assembly 400*a* with a plate 401*b* being fastened to a crosstie 402*b* in which adhesive material 401*a* extends well-beyond the plate 404*b*. Such known methods do not ensure a rail seat is repaired to a correct height, flatness and cant.

FIGS. 5A-5K illustrate an embodiment of a rail pad 502 and a tie plate 504 according to an exemplary embodiment of the present disclosure that are combined to form a rail seat assembly 500 that can be used to repair damaged rail seats of railroad systems or as an alternative to current rail seat assembly systems. As shown, both the rail pad 502 and the tie plate 504 can be transparent, translucent or the like to ensure visibility and sufficient coverage of adhesive material about the surface area of the rail seat assembly 500, when secured to a crosstie. The rail pad 502 can, for example, be comprised of BASF polyurethane. The plate 504 can, for example, be comprised of a highly impact resistant material. However, other known materials can be used as well that allow for transparency and sufficient strength to ensure the material can withstand the loading thereon.

The pad 502, which is H-shaped and has a substantially linearly extending or flat top region which minimizes the risk of rail to pad interface wear, includes a housing 506 that has a base 507 from which a first protrusion 508 and a second protrusion 510 extends. A first flange 512 extends from an outer periphery of the first protrusion 508 to delimit a first side of the pad 502 and a second flange 514 extends from an outer periphery of the second protrusion 510 to delimit a second side of the pad 502. The plate 504 is mounted to the pad 502 by protrusions 511 such as pins or the like that extend from the pad 502. Insulators 516 are attached to the assembly 500 as well and pins extend from the assembly to allow the assemblies 500 to be securely stacked for shipping purposes.

Figure 5A:
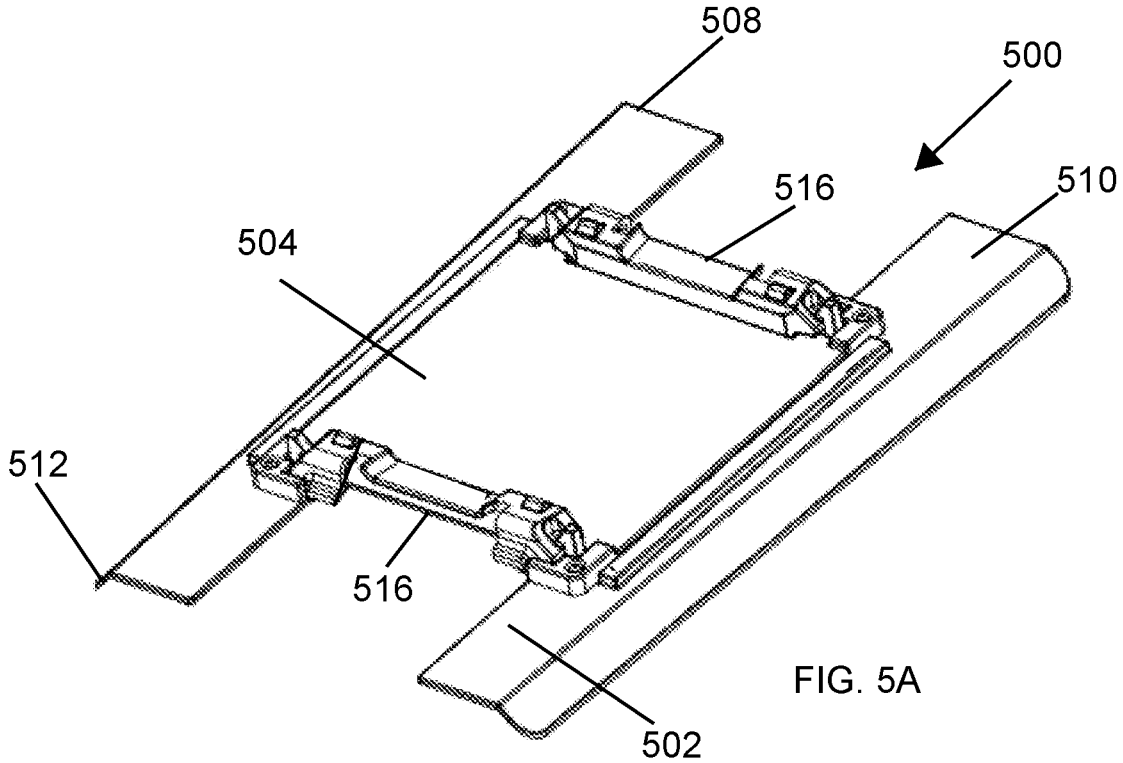
FIGS. 5A-5K are various views of a transparent rail seat assembly of an exemplary embodiment of the present disclosure.
Figure 5B:
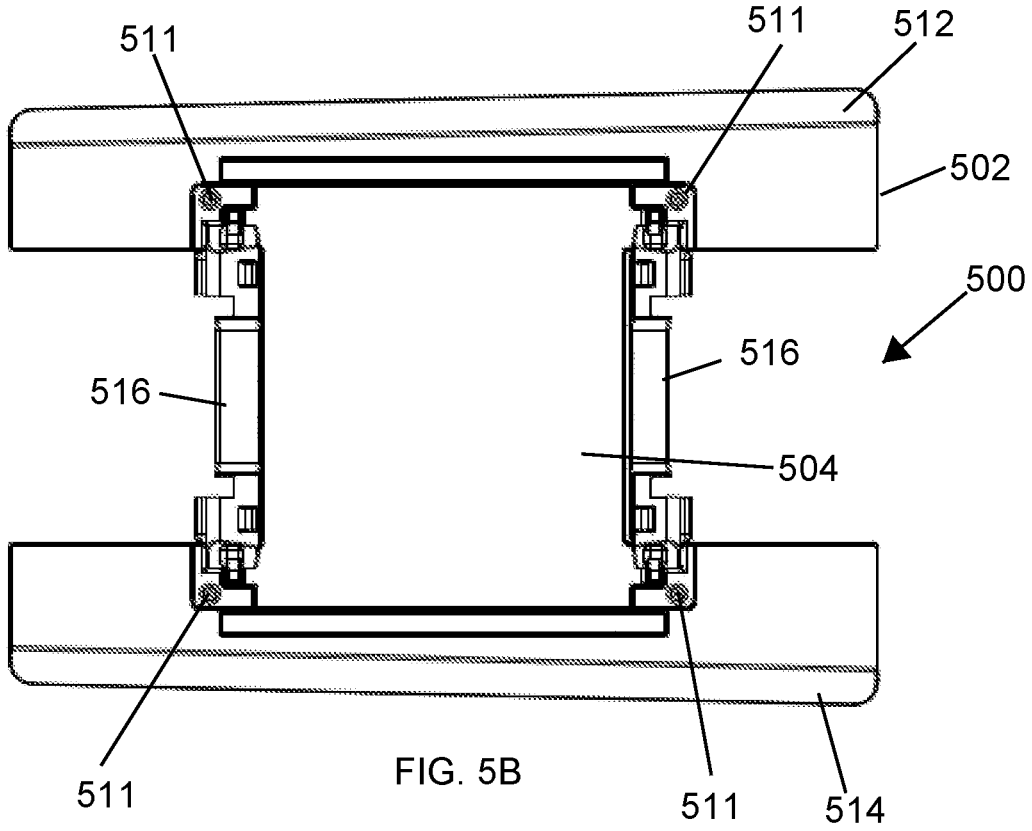
Figure 5C:
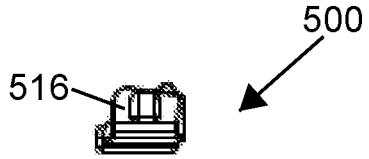
Figure 5D:
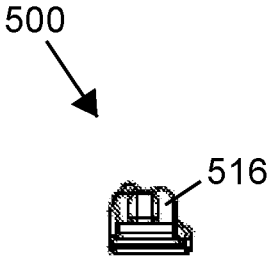
Figure 5E:
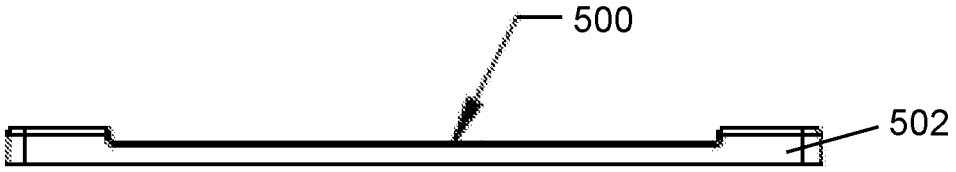
Figure 5F:
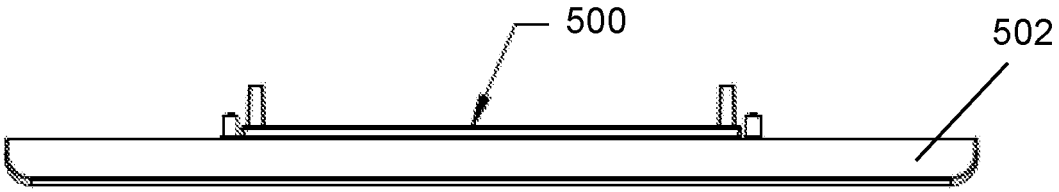
Figures 5G, 5H, 5I, 5J:
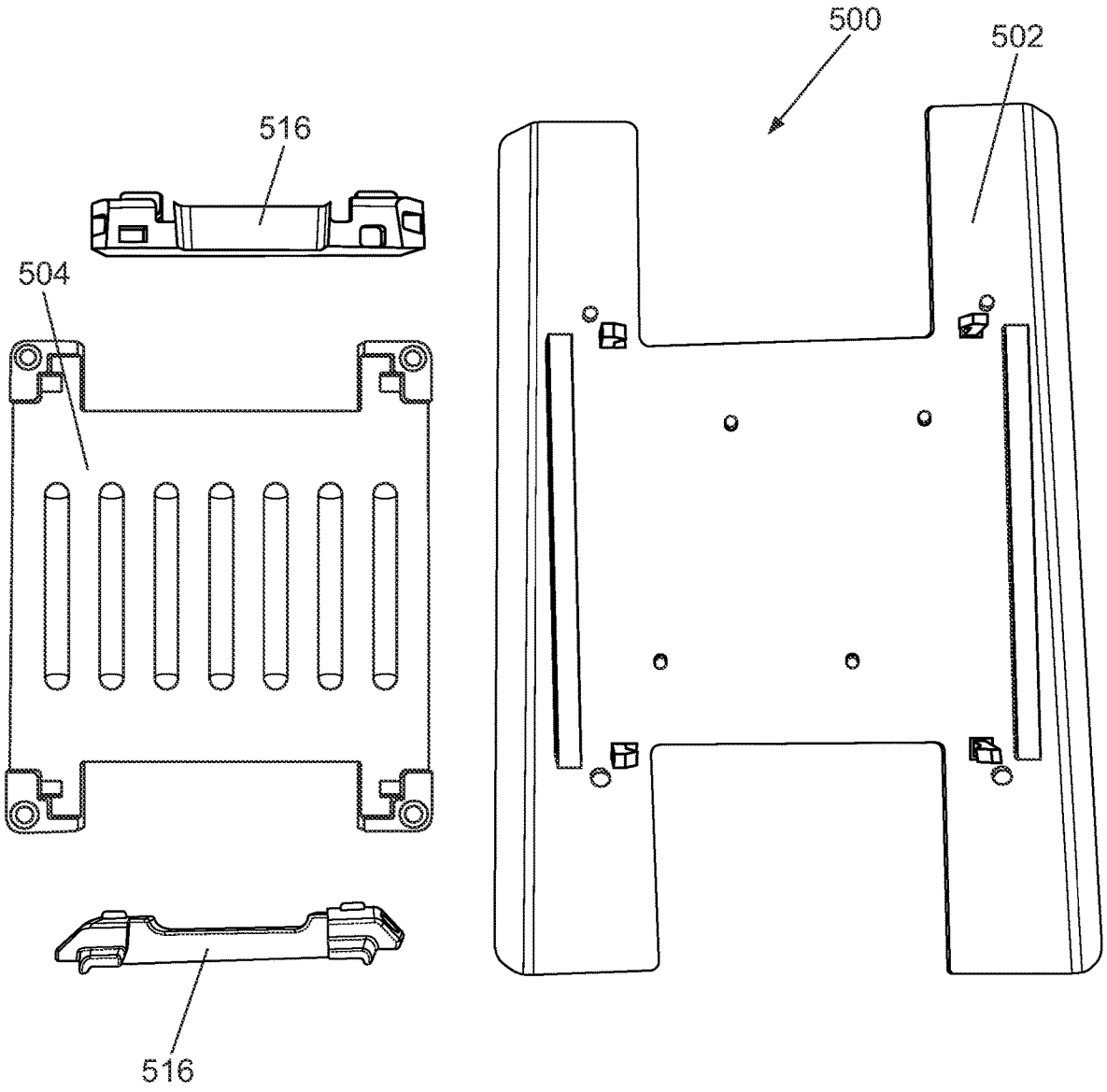
Figure 5K:
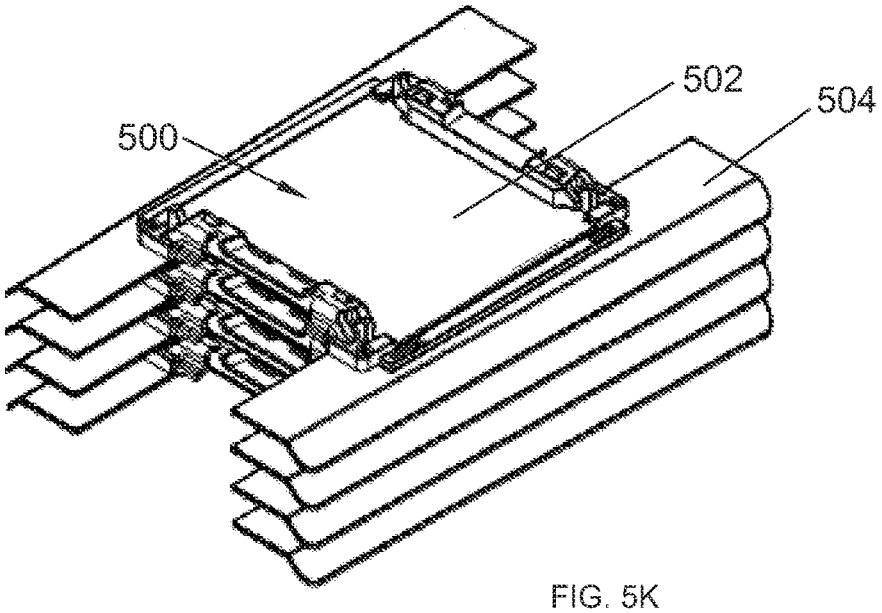
Figure 5L:
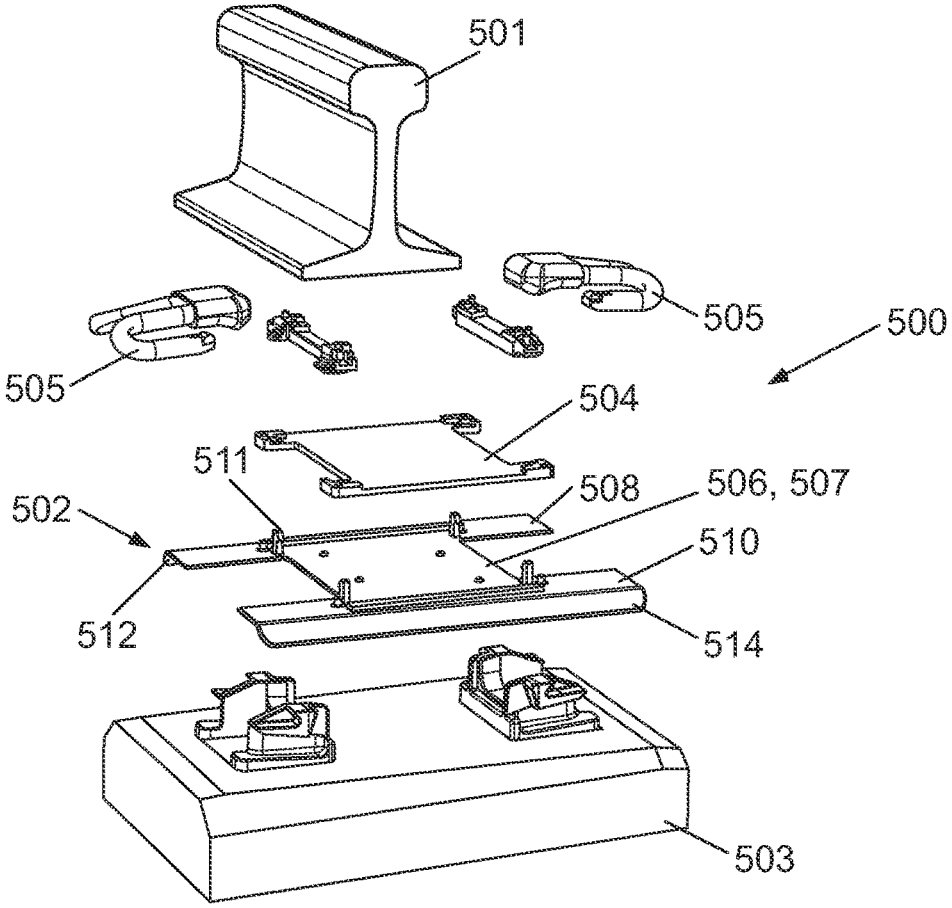
FIG. 5L is an exploded view of a rail system that includes the rail seat assembly of FIGS. 5A-5J.
Figure 6A:
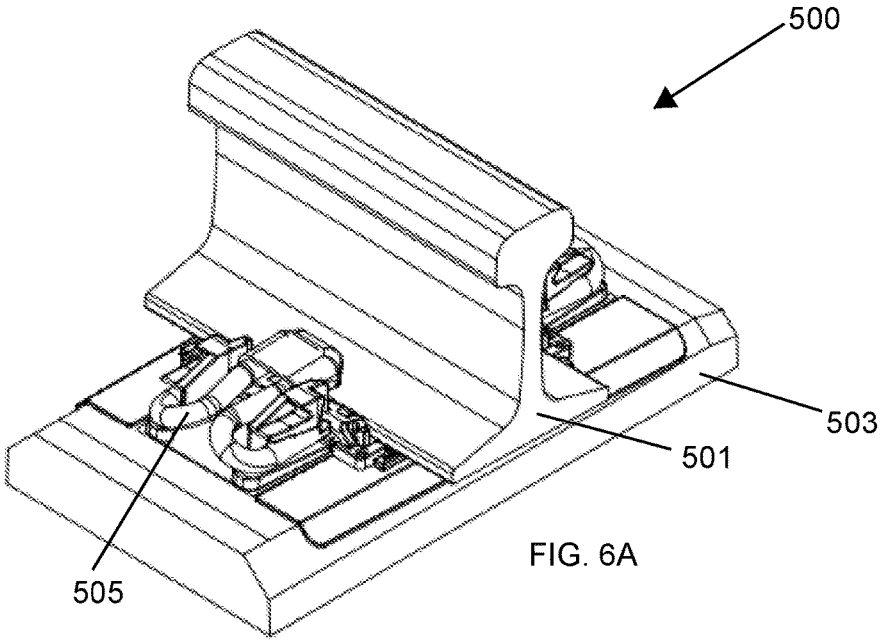
FIGS. 6A-6C are various views of a rail seat assembly that includes the transparent rail seat assembly of FIGS. 5A-5J.
Figure 6B:
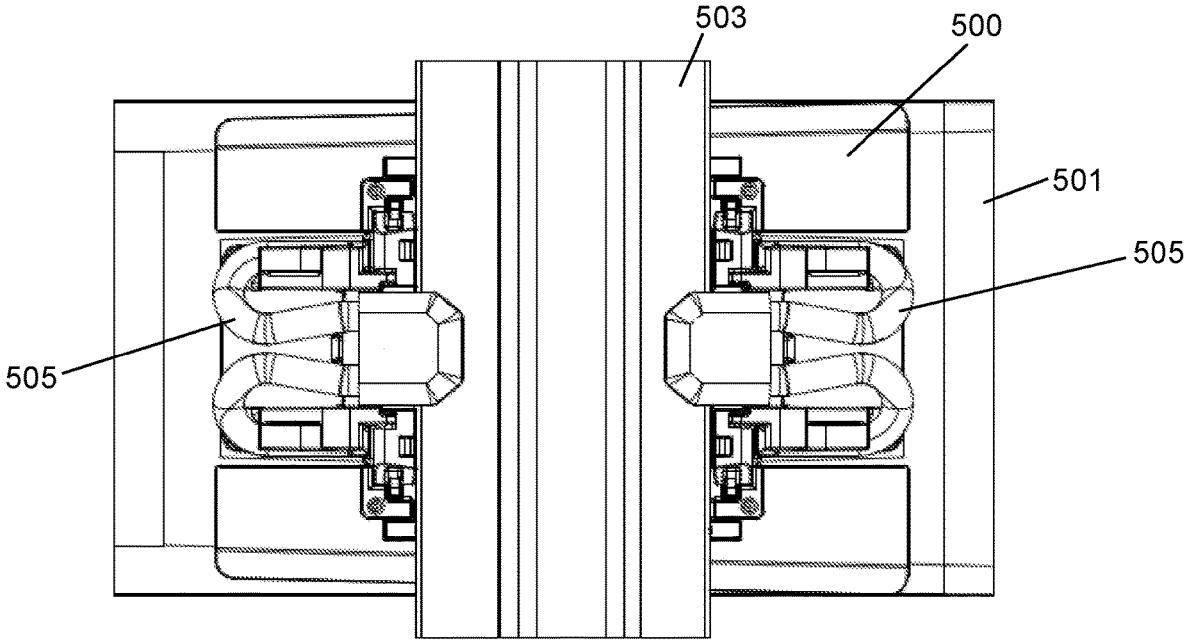
Figure 6C:
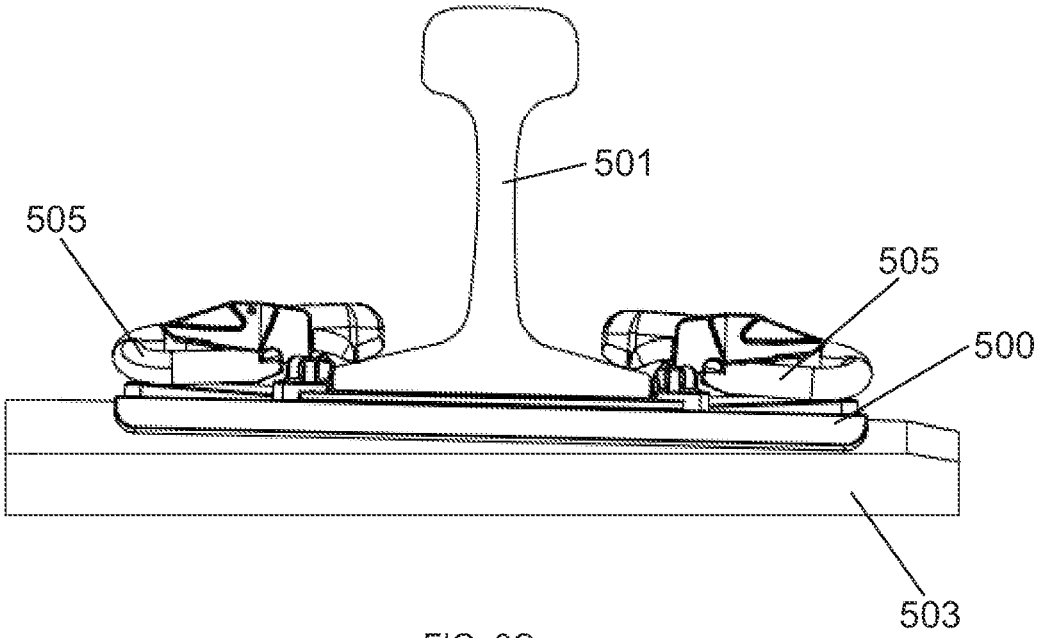

FIG. 5L is an exploded view of the rail seat assembly 500 and various components of a rail system including a rail 501, a crosstie 503 and clips 505. FIGS. 6A-6C are various views of the rail seat assembly 500 arranged in a rail system.

FIGS. 7A-7F are various views of steps of the rail seat assembly 500 being installed on a concrete crosstie 503.

Figure 8A:
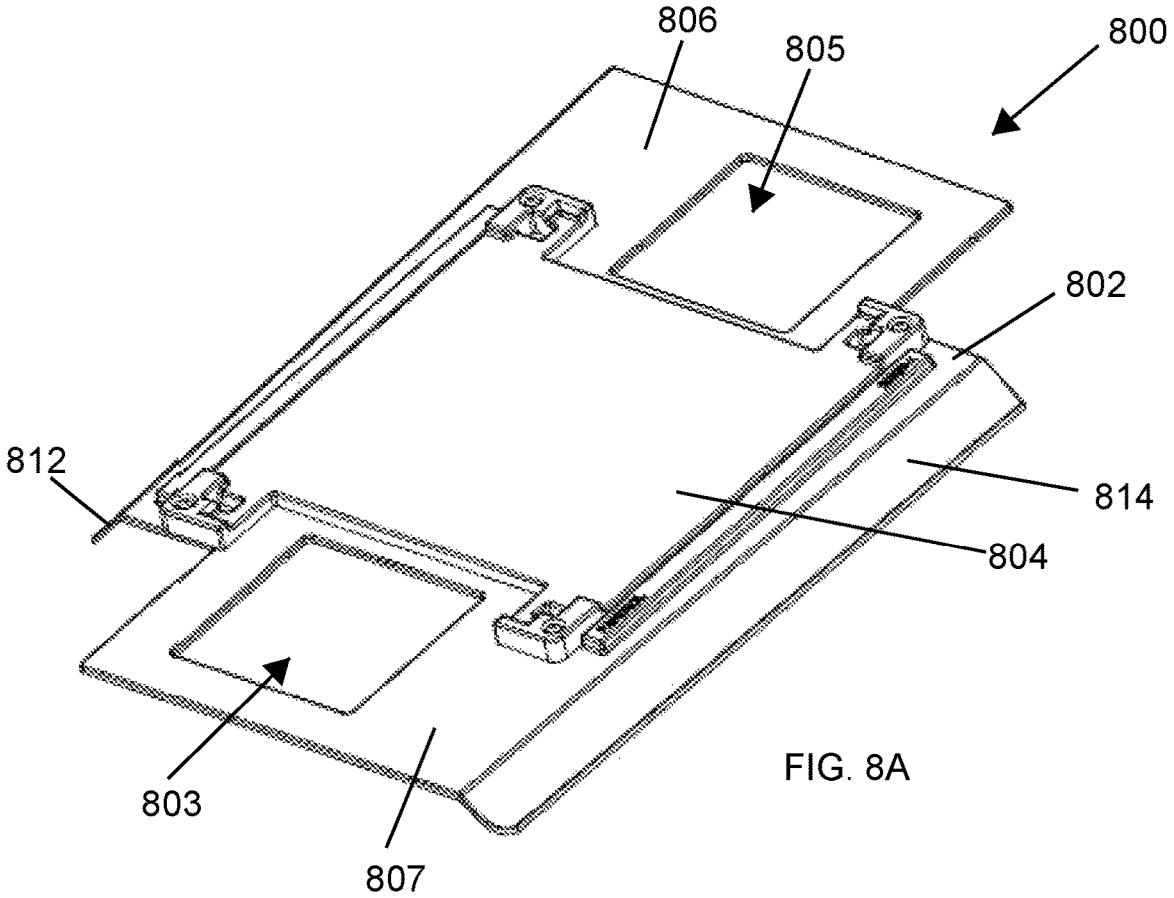
FIGS. 8A-8F are various views of a rail seat assembly of an exemplary embodiment of the present disclosure.
Figure 8B:
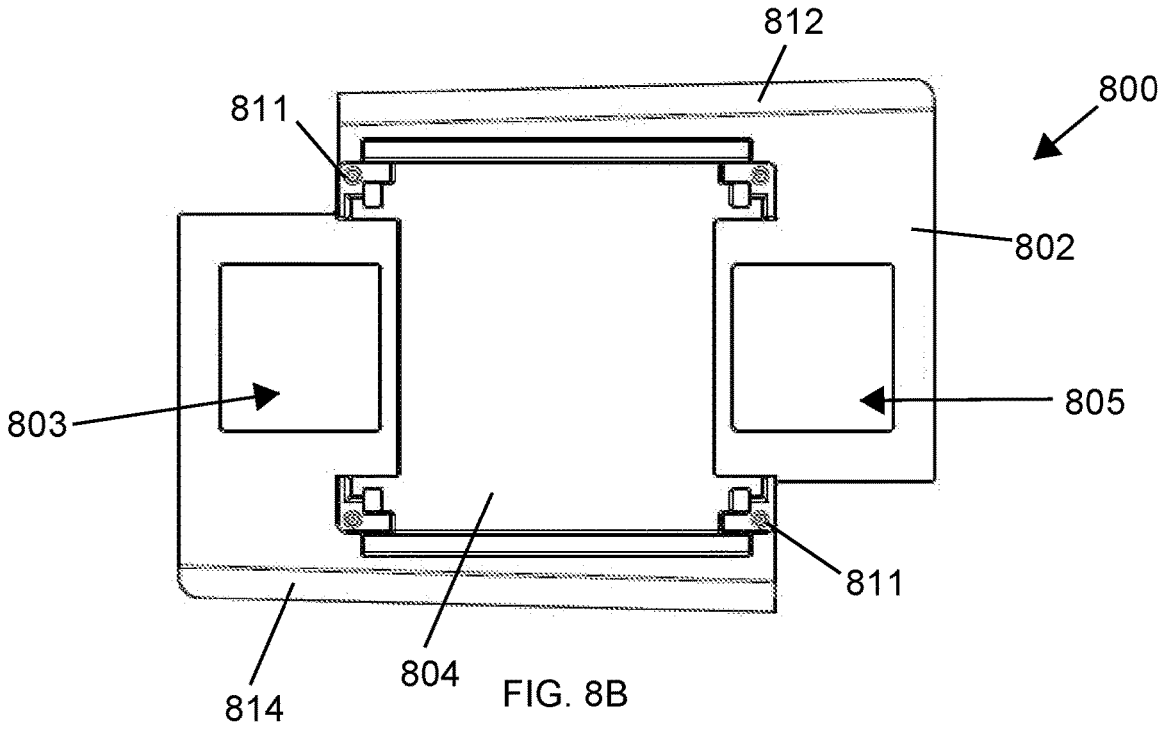
Figure 8C:
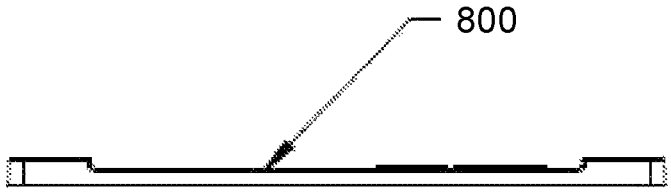
Figure 8D:
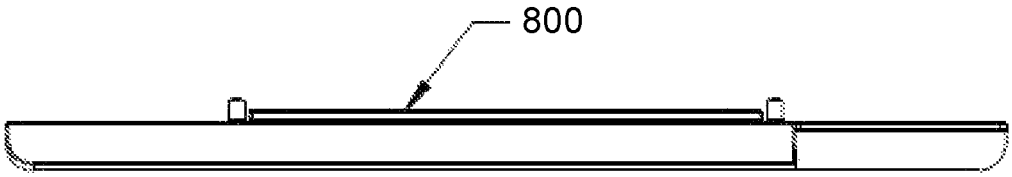
Figure 8E:
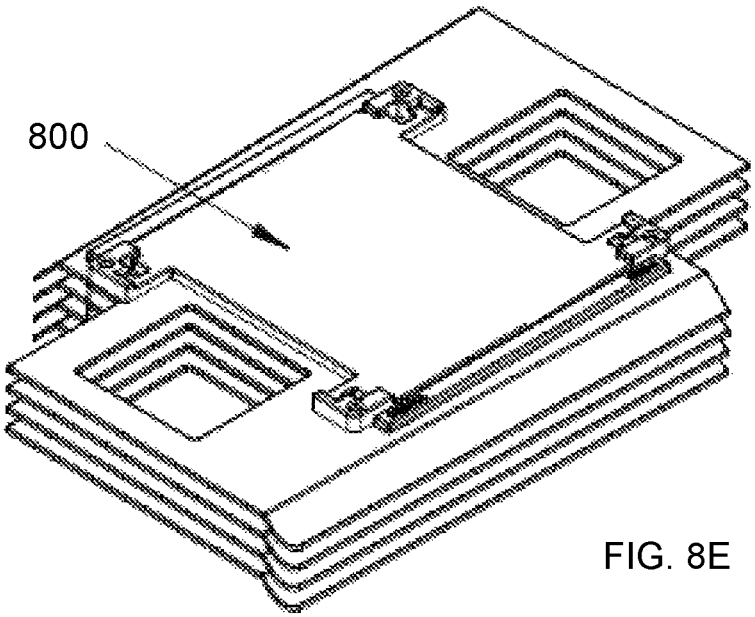
Figure 8F:
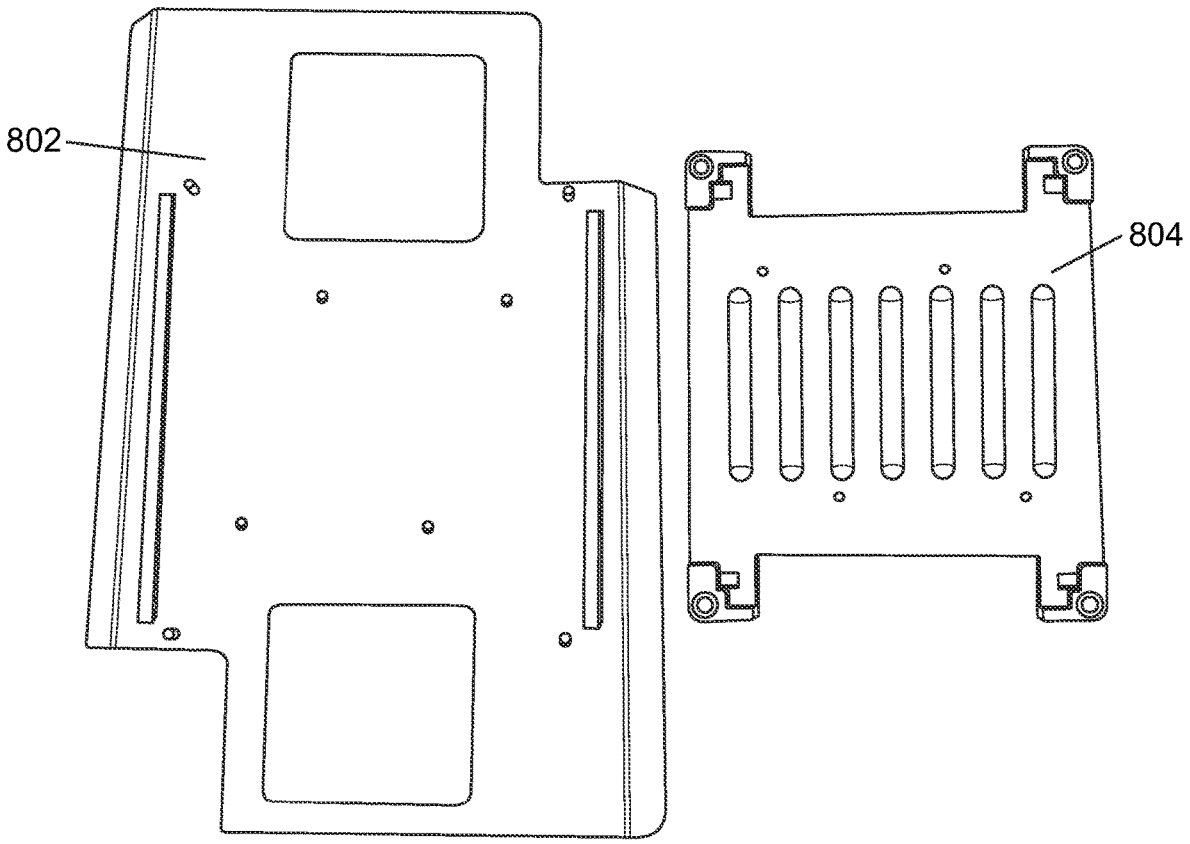

FIG. 8A depicts an abraded rail seat 703 of a crosstie 701. To repair an abraded rail seat 703, three items are needed: (1) the rails seat 703 needs to be restored back to its original height (e.g., the abraded area needs to be filled in with a material such as an epoxy); (2) the rail seat needs to have a proper cant (typically 1:40); and (3) the rail seat needs to be flat to avoid stress risers under the rail. For height, the transparency of the rail seat assembly 500 allows visual confirmation that the rail seat is properly filled and allows for adjustment of epoxy as needed as different track locations will have differing amounts of abrasion. The rail seat assembly 500 aids in ensuring the cant will be restored to 1:40 by having the pad 502 (shoulder and sides) extend to an undamaged portion of the crosstie 503. As will be discussed below, a hand tool can be used to ensure proper flatness that in combination with the abrasion plate ensures flatness and that the plastic assembly sits flush on the concrete crosstie.

Figure 7A:
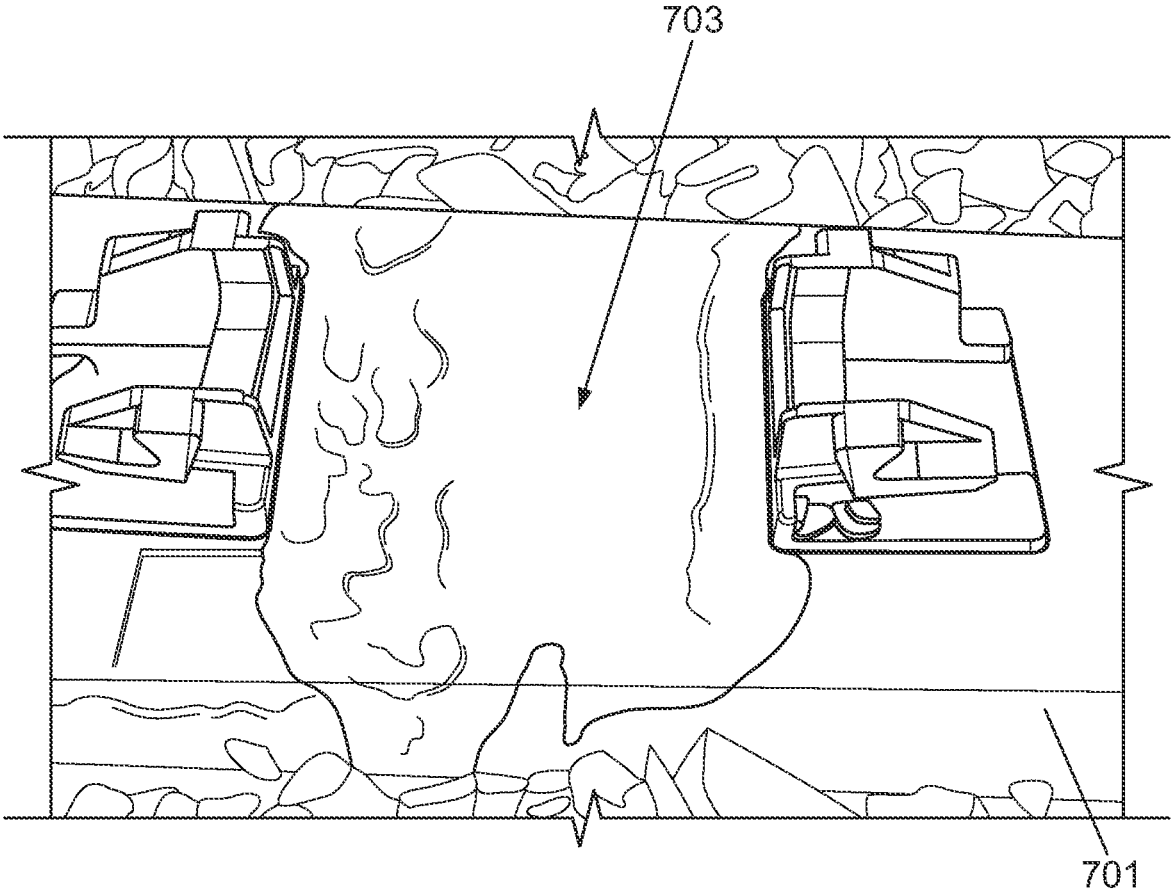
FIGS. 7A-7F show various views of the rail seat assembly of FIGS. 5A-5J being installed on a crosstie.
Figure 7B:
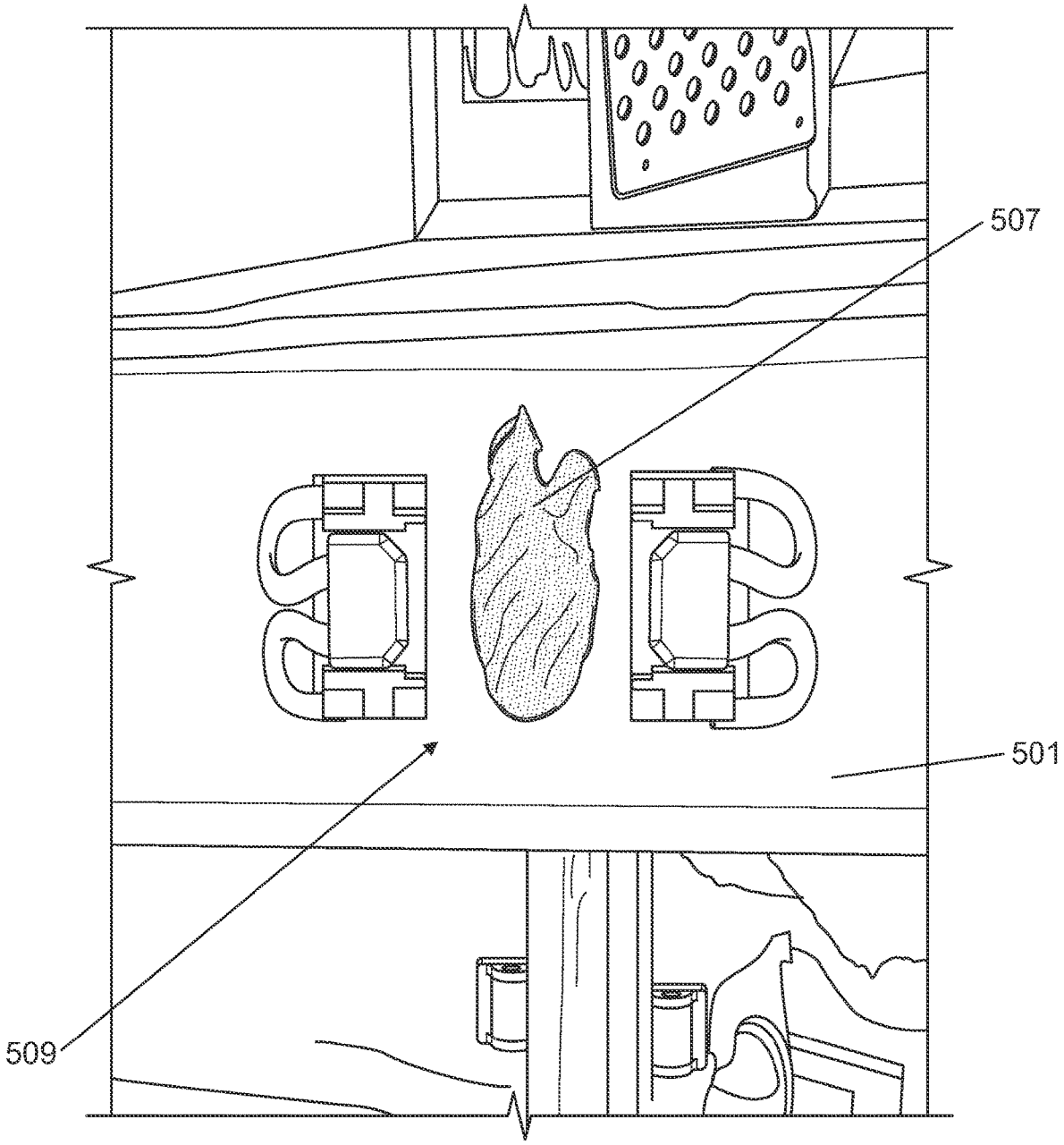
Figure 7C:
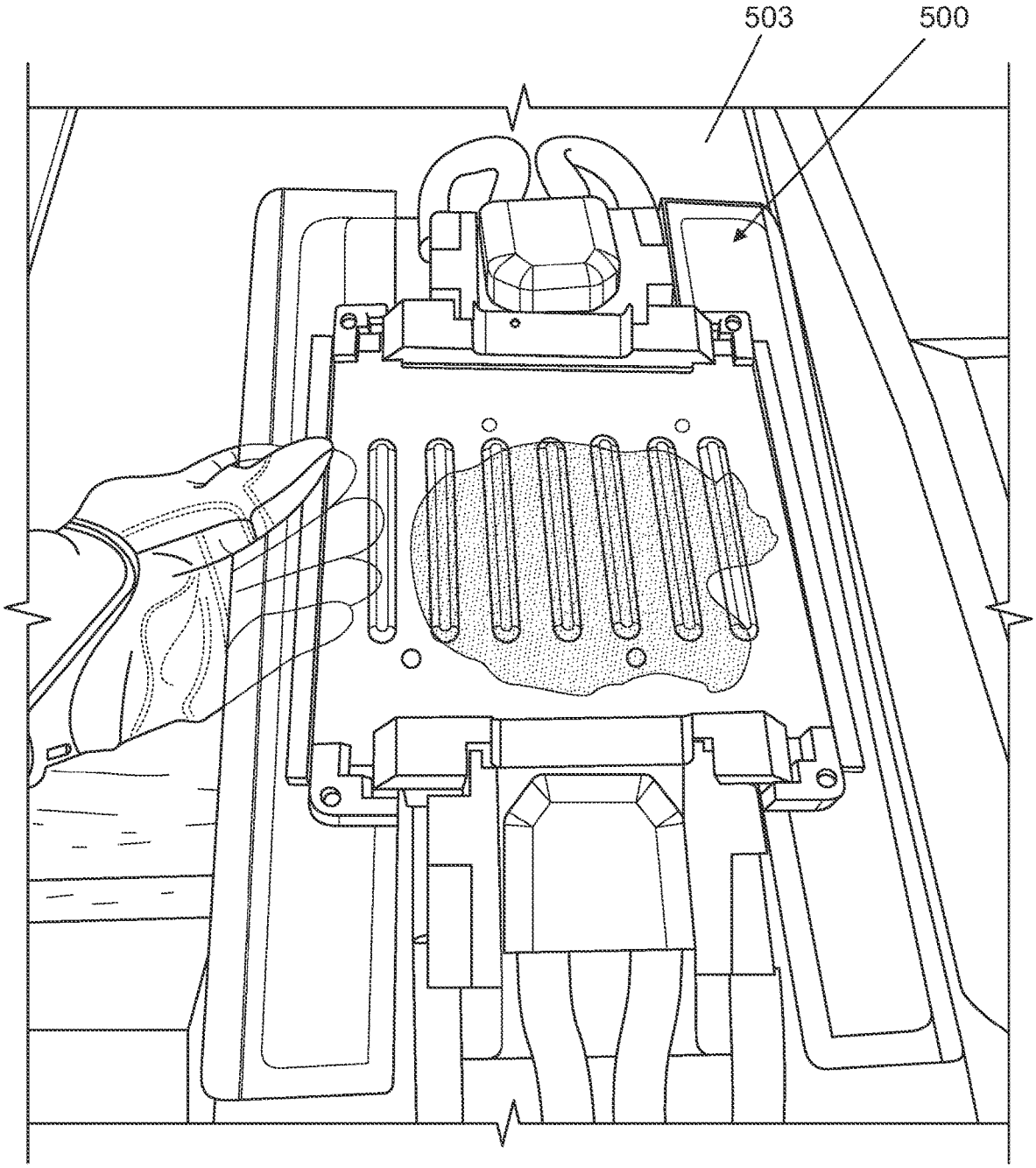
Figure 7D:
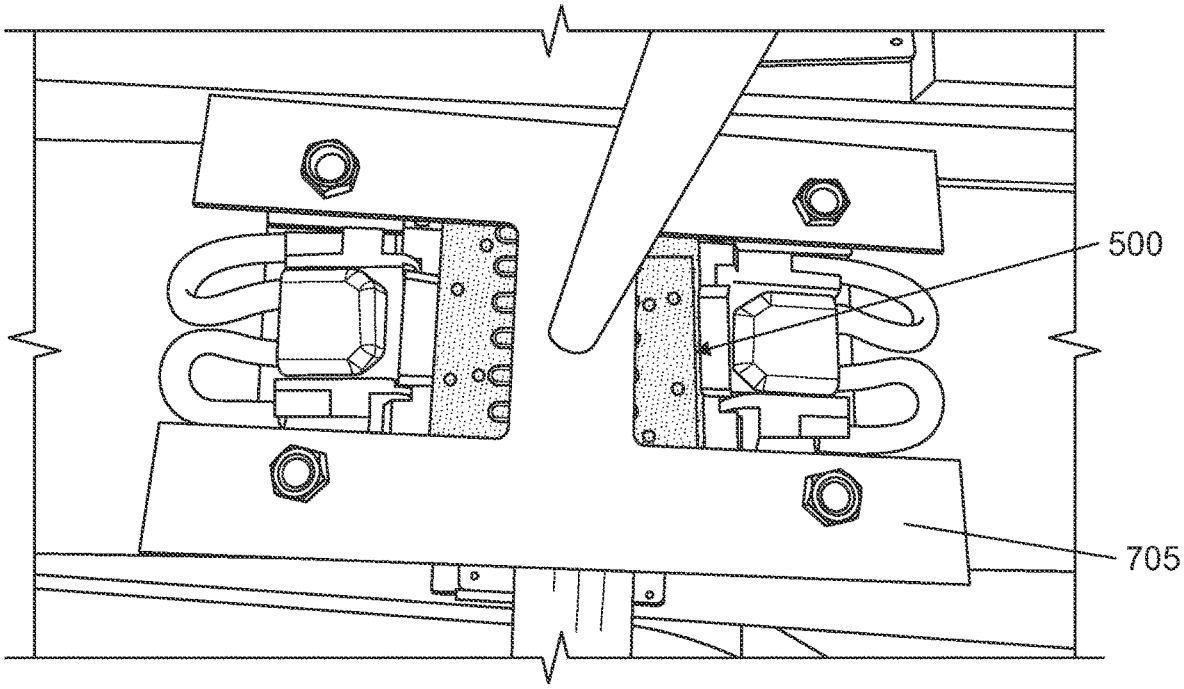
Figure 7E:
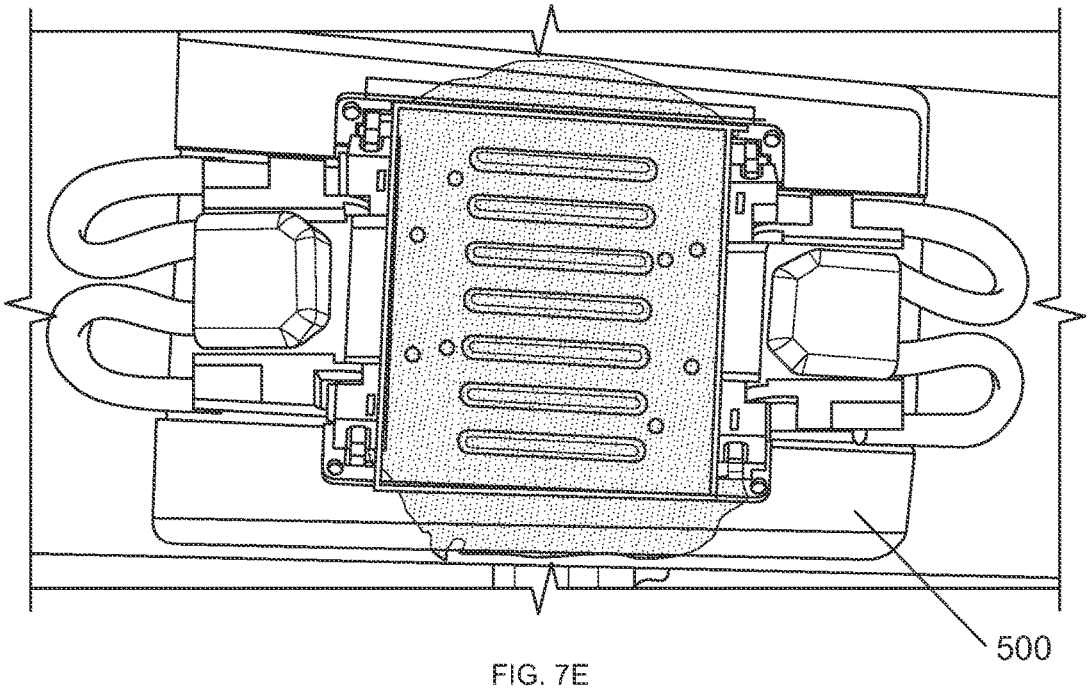
Figure 7F:
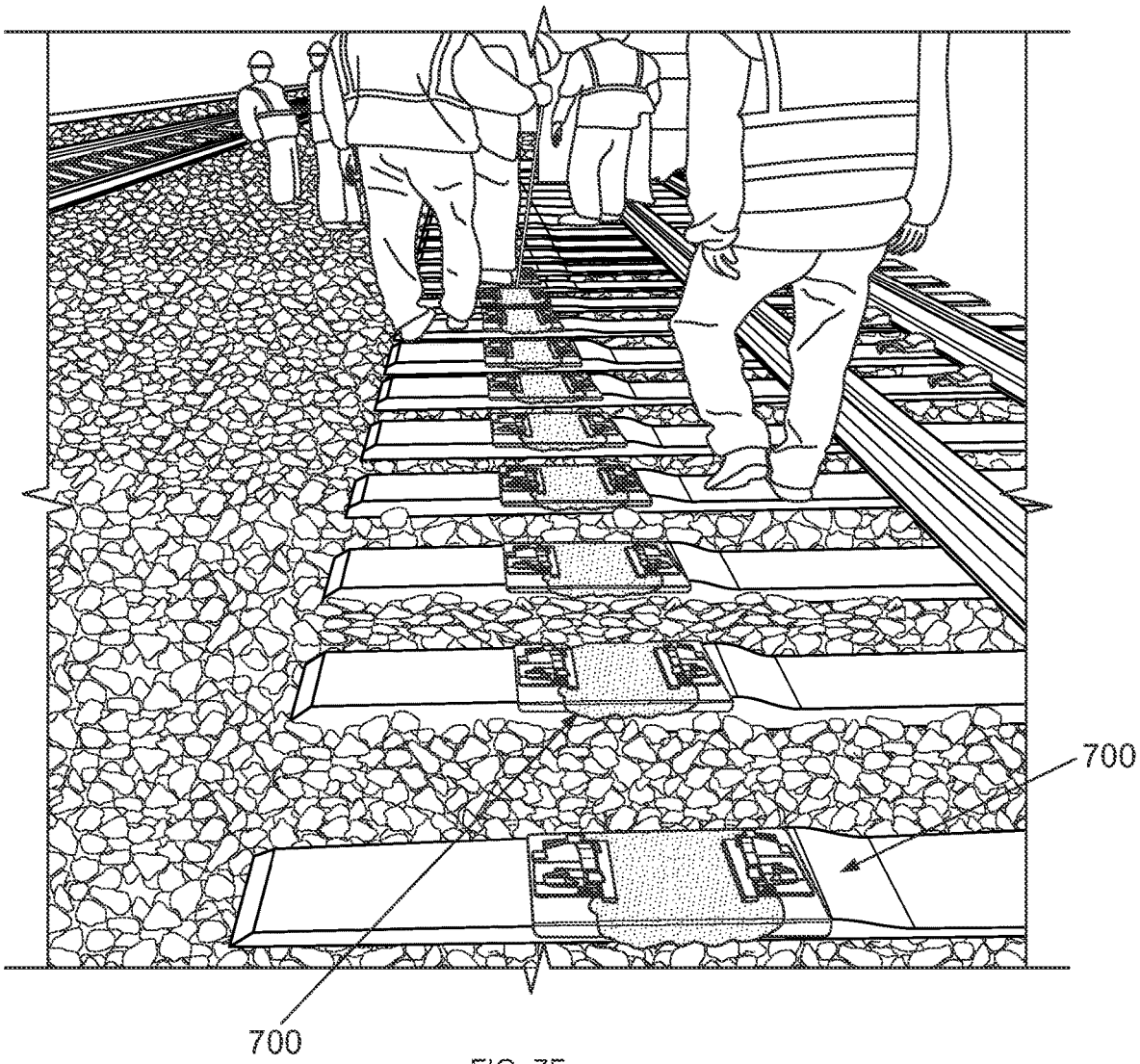

After the rail seat is cleaned, as shown in FIG. 7B, epoxy is applied to abraded areas 509 of the rail seat on the concreate crosstie 503. The rail seat assembly 500 is then placed over the epoxy on the crosstie 503 as depicted in FIG. 7C. If clips are being reused, they can be arranged in the parked position as shown. Next, in FIG. 7D, a hand tool 705 is arranged over the rail seat assembly 500 and pressure is applied to the hand tool 705 in order to adjust the rail seat to a proper height, cant and flatness by pressing the plate into the uncured rail seat repair compound. For slightly abraded rail seats, a hand tool 705 is not required (as the plate under the pad provides enough rigidity). Then as shown in FIG. 7E the abraded is area is visually checked to ensure the area is fully covered by repair material. If too little repair material is applied, dial in the amount to the following ties because abrasion depth and pattern are usually similar throughout track sections. If the abraded area is only on the filled side (see indication of "F" in FIG. 7C), then an adhesive material is only needed for half of the rail seat. FIG. 7F shows a plurality of rail seat assemblies 500 being used in track repair.

The rail seat assembly 500 provides a fully captive plastic assembly, minimizing handling of components in track as the pad, plate and field and gage insulators are fully captive and the FC need not be completely taken off, instead just pulled back into a maintenance position. The top pad 502 minimizes risk of rail to pad interface wear. Additionally, both the abrasion plate and the insulators have dedicated features that restrain the pad 502 from slipping or stretching. All of the components of the rail seat assembly 500 are UV stabilized and as such, the components of the rail seat assembly 500 will not degrade to weather exposure and the transparency of the pad 502 and plate 504 will be protected.

FIGS. 8A-8F illustrate an embodiment of a rail pad 802 and a tie plate 804 according to an embodiment of the present disclosure that are combined to form a rail seat assembly 800 that can be used to repair damaged rail seats of railroad systems or as an alternative to current rail seat assembly systems. As shown, both the rail pad 802 and the tie plate 804 can be transparent, translucent or the like to ensure visibility and sufficient coverage of adhesive material about the surface area of the rail seat assembly 800, when secured to a crosstie. The rail pad 802 can, for example, be comprised of BASF polyurethane. The plate 804 can, for example, be comprised of a highly impact resistant material. However, other known materials can be used as well that allow for transparency or translucency and sufficient strength to ensure the material can withstand the loading thereon.

The pad 802 includes a housing 806 that has a base 807 with a first opening 803 and a second opening 805. A first flange 812 extends from an outer periphery of the base 807 to delimit a first side of the pad 802 and a second flange 814 extends from an outer periphery of the base 807 to delimit a second side of the pad 802. The plate 804 is mounted to the pad 802 by protrusions 811 such as pins or the like that extend from the pad 802. Pins extend from the assembly to allow the assemblies 800 to be stacked for shipping purposes. The rail seat assembly 800 is fully captive such that the pad 802, the plate 804 and gage insulators are fully captive and minimal disruption to an existing system is required for installation (i.e., the height of the FC insulators are significantly reduced to allow for more efficient packaging and worker handling of the product).

Figure 8G:
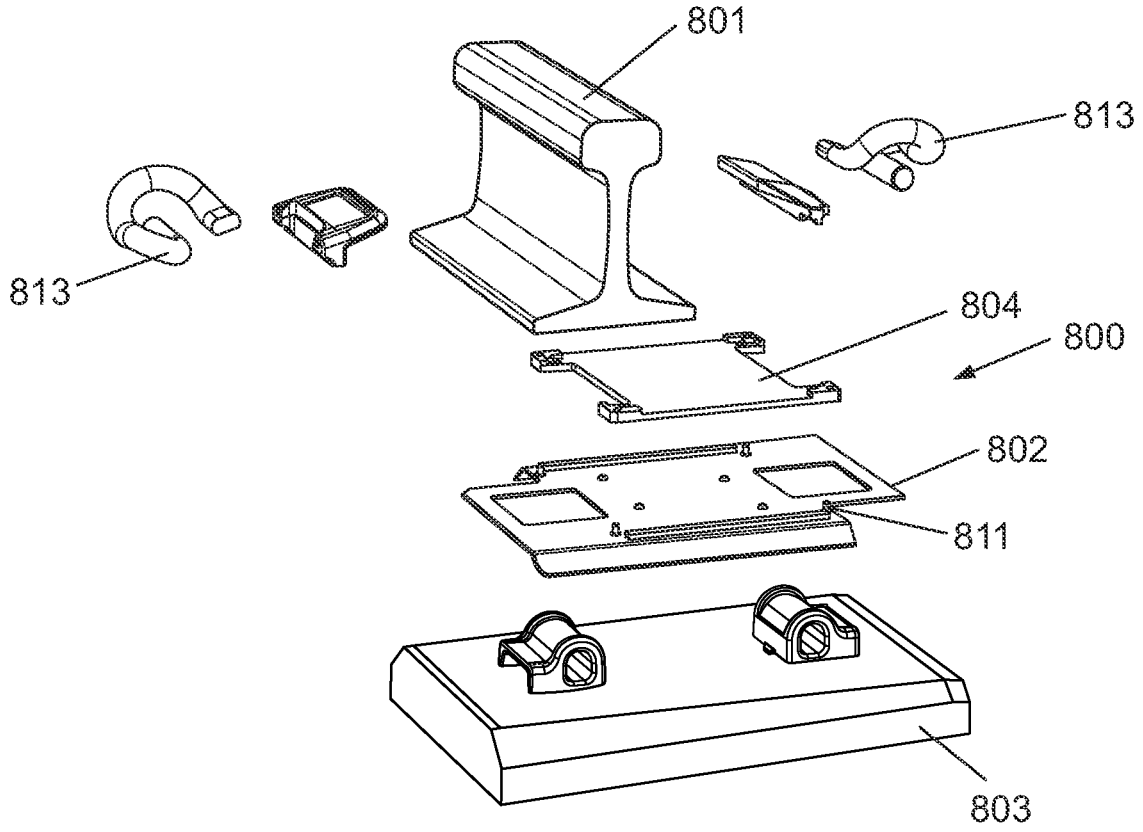
FIG. 8G is an exploded view of a rail system that includes the rail seat assembly of FIGS. 8A-8F.
Figure 9A:
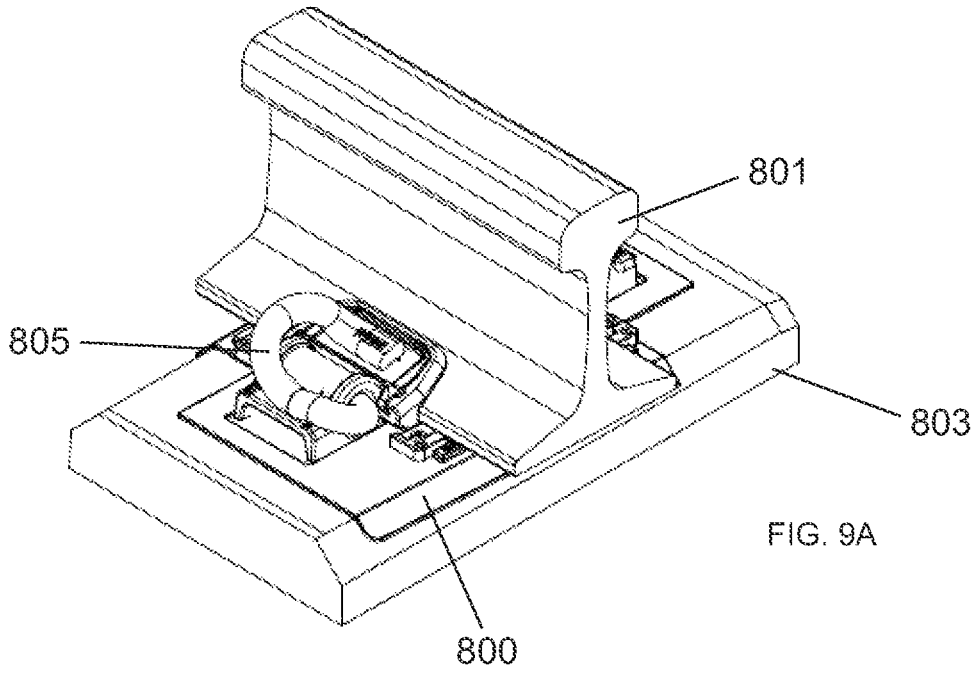
FIGS. 9A-9C are various views of a rail seat assembly that includes the transparent rail seat assembly of FIGS. 8A-8F.
Figure 9B:
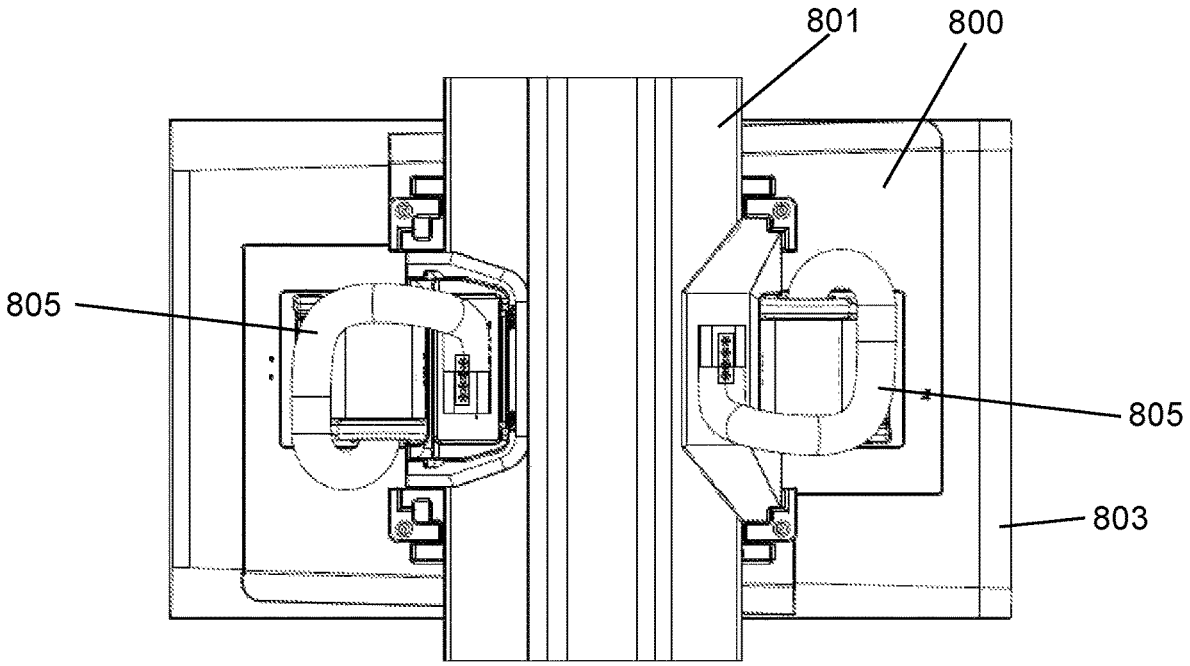
Figure 9C:
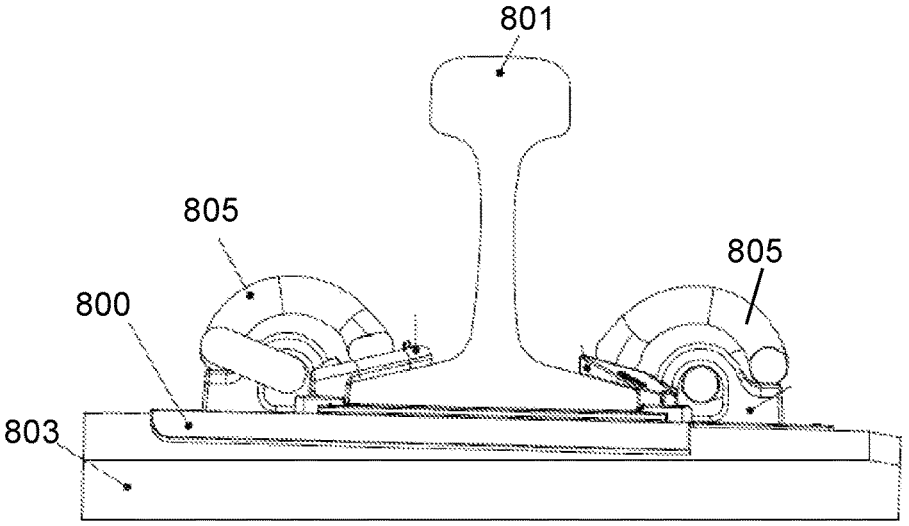

FIG. 8G is an exploded view of the rail seat assembly 800 and various components of a rail system including a rail 801, a crosstie 803, clips 813 including in a rail system and FIGS. 9A-9C are various views of the rail seat assembly 800 arranged in a rail system.

Figure 10A:
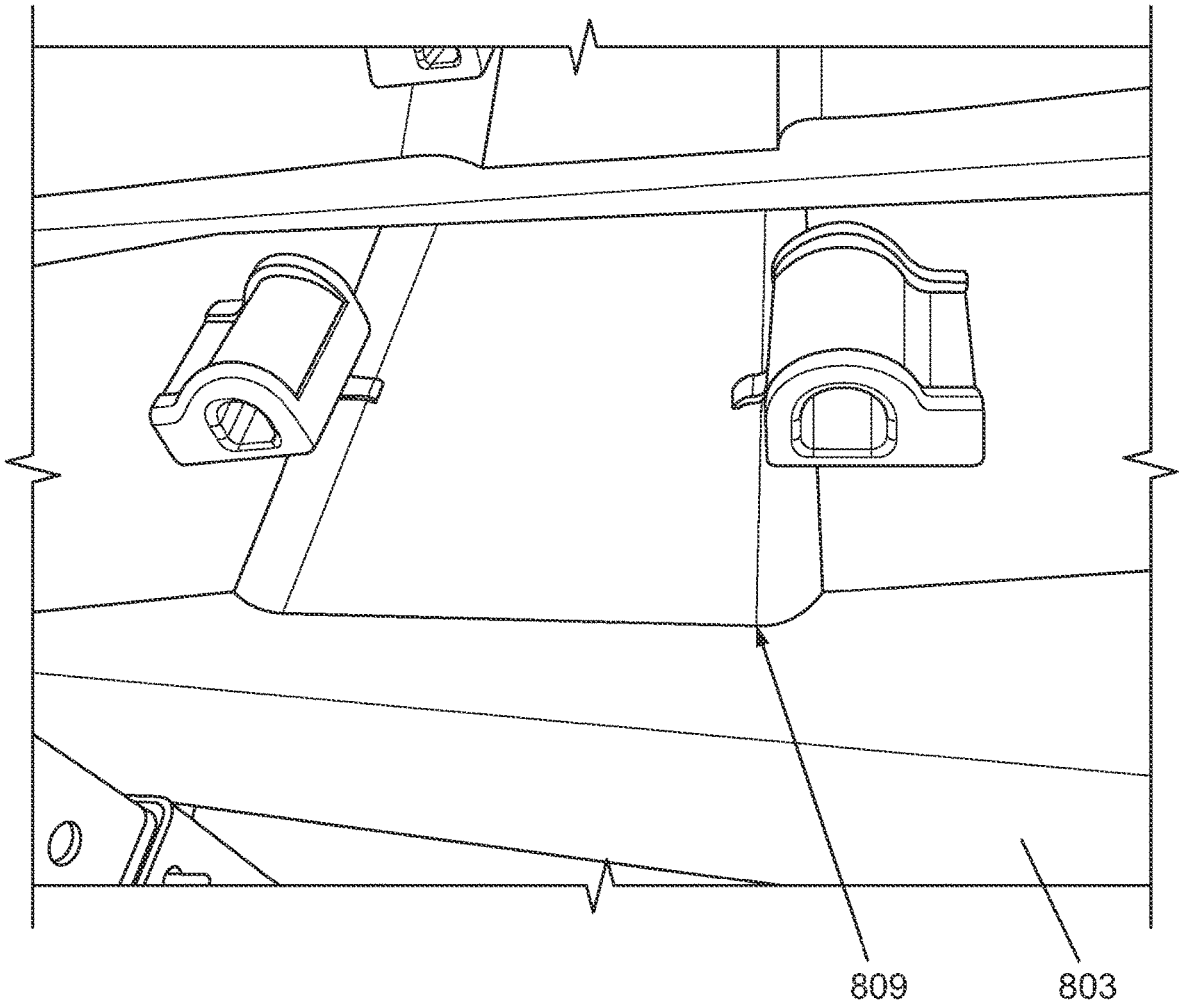
FIGS. 10A-10E show various views of rail seat assembly of FIGS. 8A-8F being installed on a crosstie.

FIGS. 10A-10F illustrate sequentially various views of steps of the rail seat assembly 800 being installed on a concrete crosstie 803. FIG. 10A depicts an abraded rail seat 809. To repair an abraded rail seat 809, three items are needed: (1) the rails seat needs to be restored back to its original height (e.g., the abraded area needs to be filled in with a material 811 such as an epoxy); (2) the cant of the rail seat must be restored (e.g., to a 1:40 cant); and (3) the rail seat needs to be flat to avoid stress risers under the rail. For height, the transparency of the rail seat assembly 800 allows visual confirmation that the rail seat is properly filled and allows for adjustment of epoxy as needed as different track locations will have differing amounts of abrasion. The rail seat assembly 800 aids in ensuring the cant will be restored to, for example, 1:40 by having the pad 802 (shoulder and sides) extend to an undamaged portion of the crosstie 803. The hand tool 705 is used to ensure proper flatness that in combination with the abrasion plate ensures flatness and that the plastic assembly sits flush on the concrete crosstie.

Figure 10B:
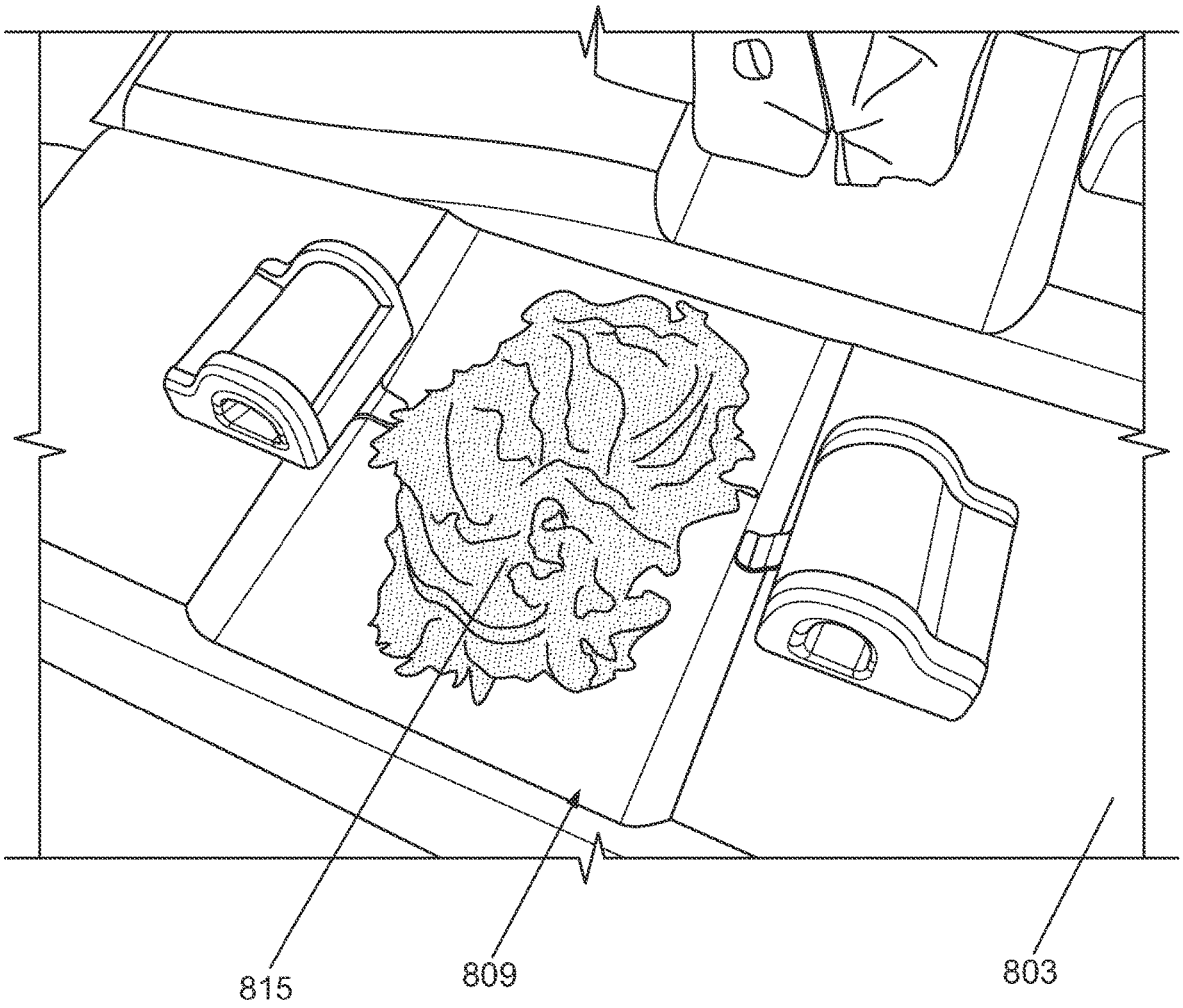
Figure 10C:
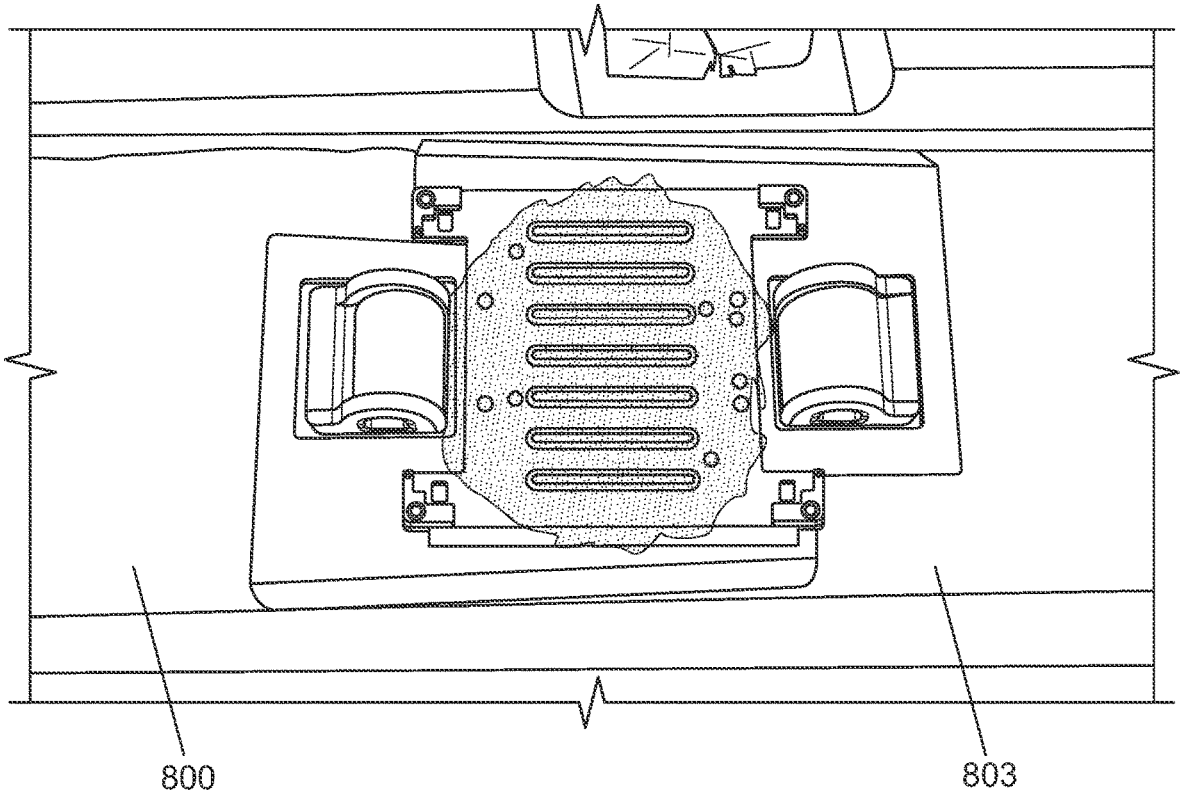
Figure 10D:
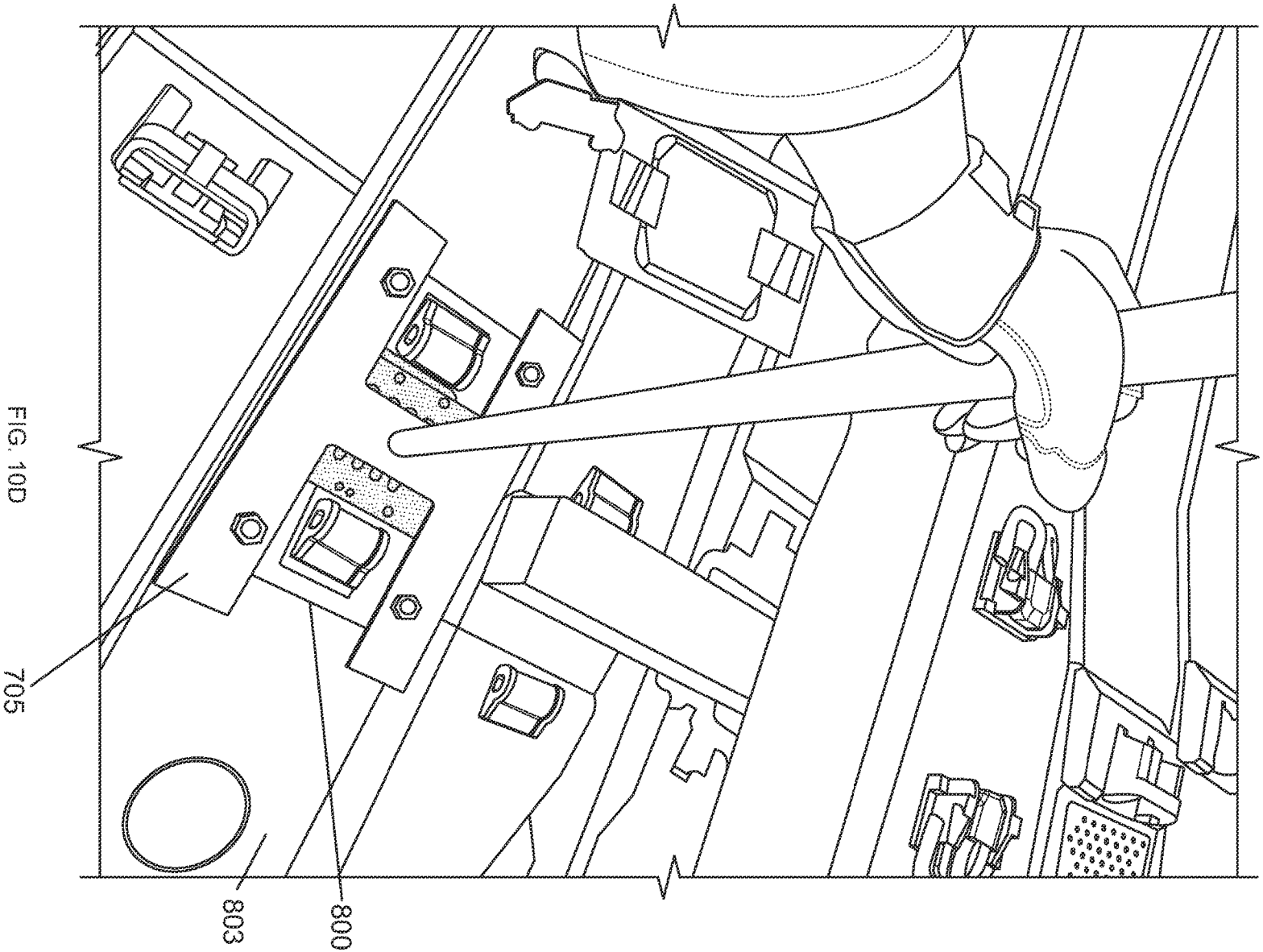
Figure 10E:
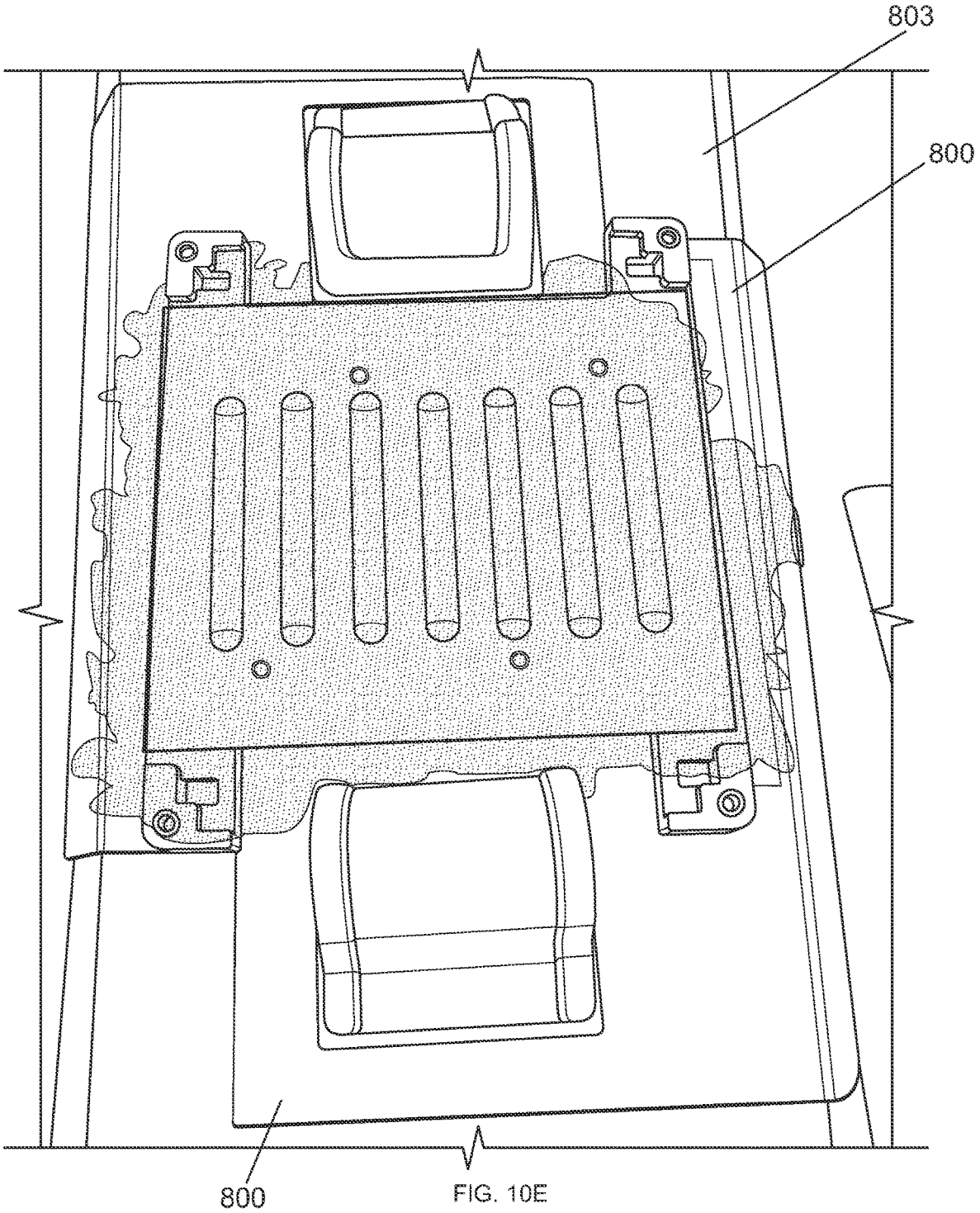
Figure 11A:
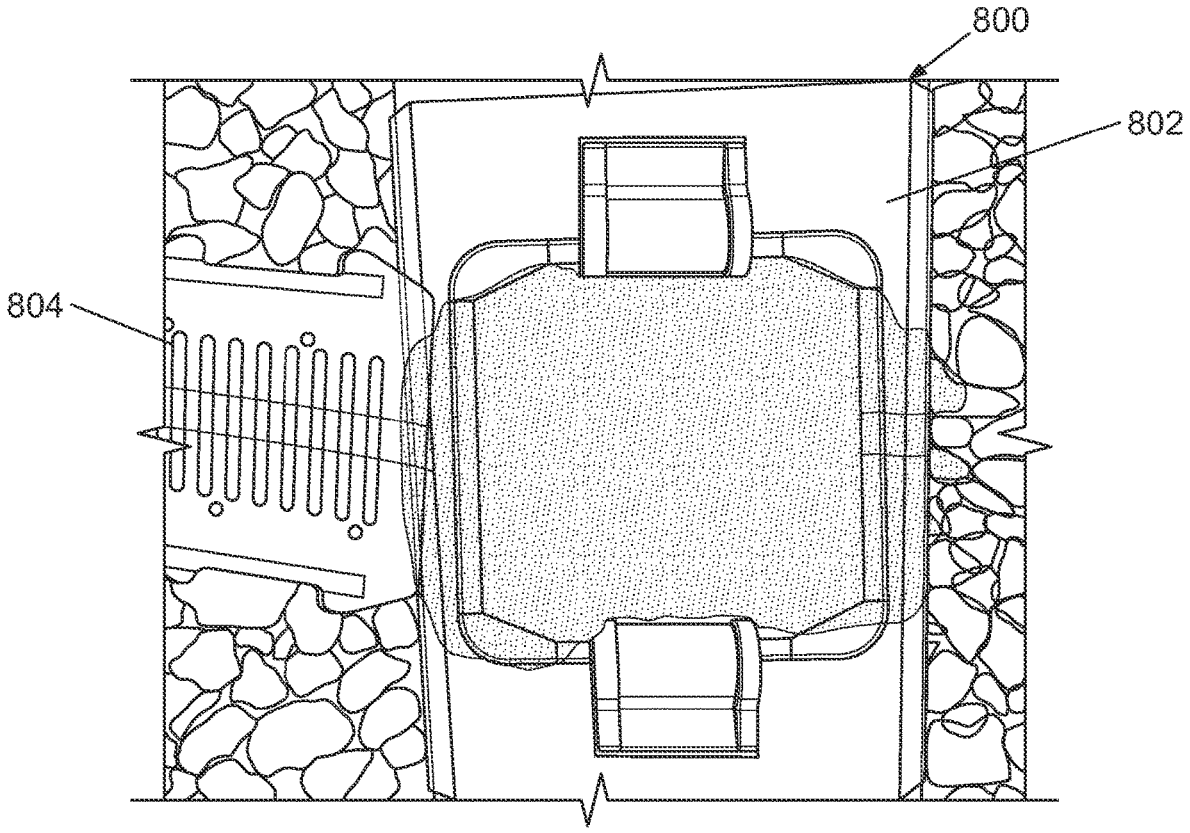
FIGS. 11A-11F show various views of an embodiment of a transparent rail seat assembly of the present disclosure.
Figure 11B:
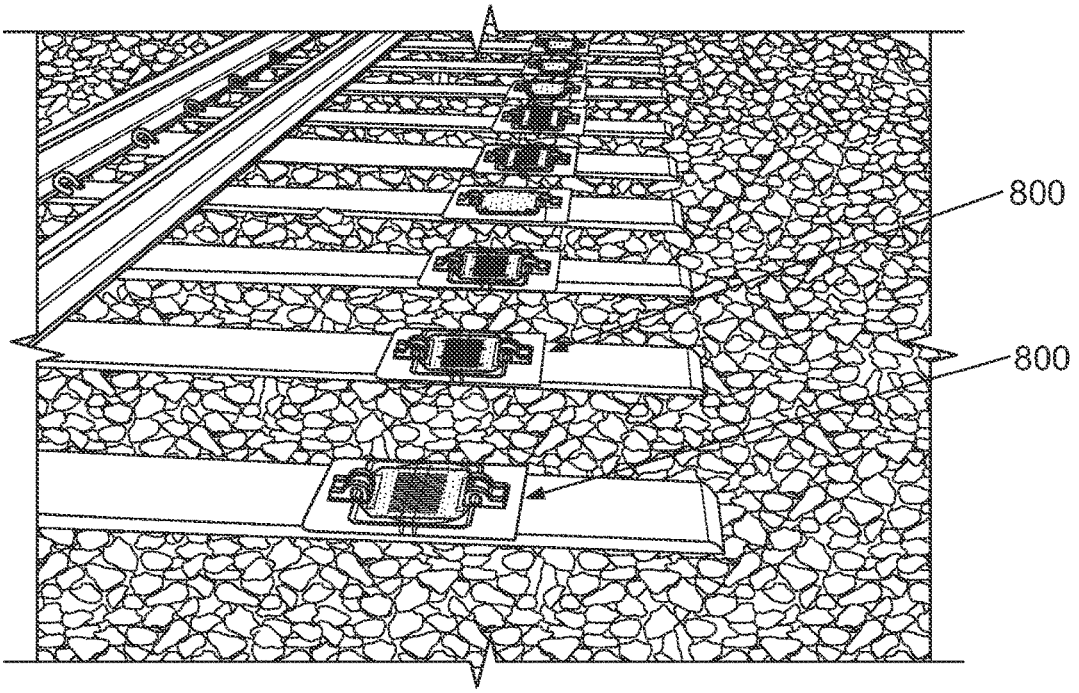
Figure 11C:
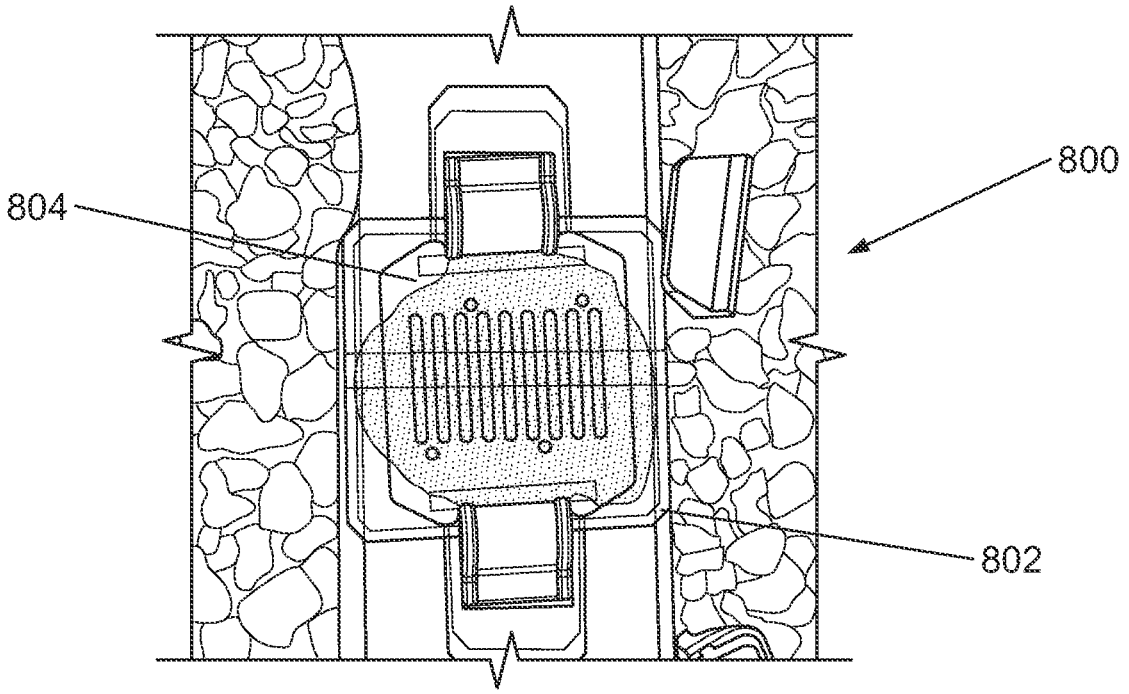
Figure 11D:
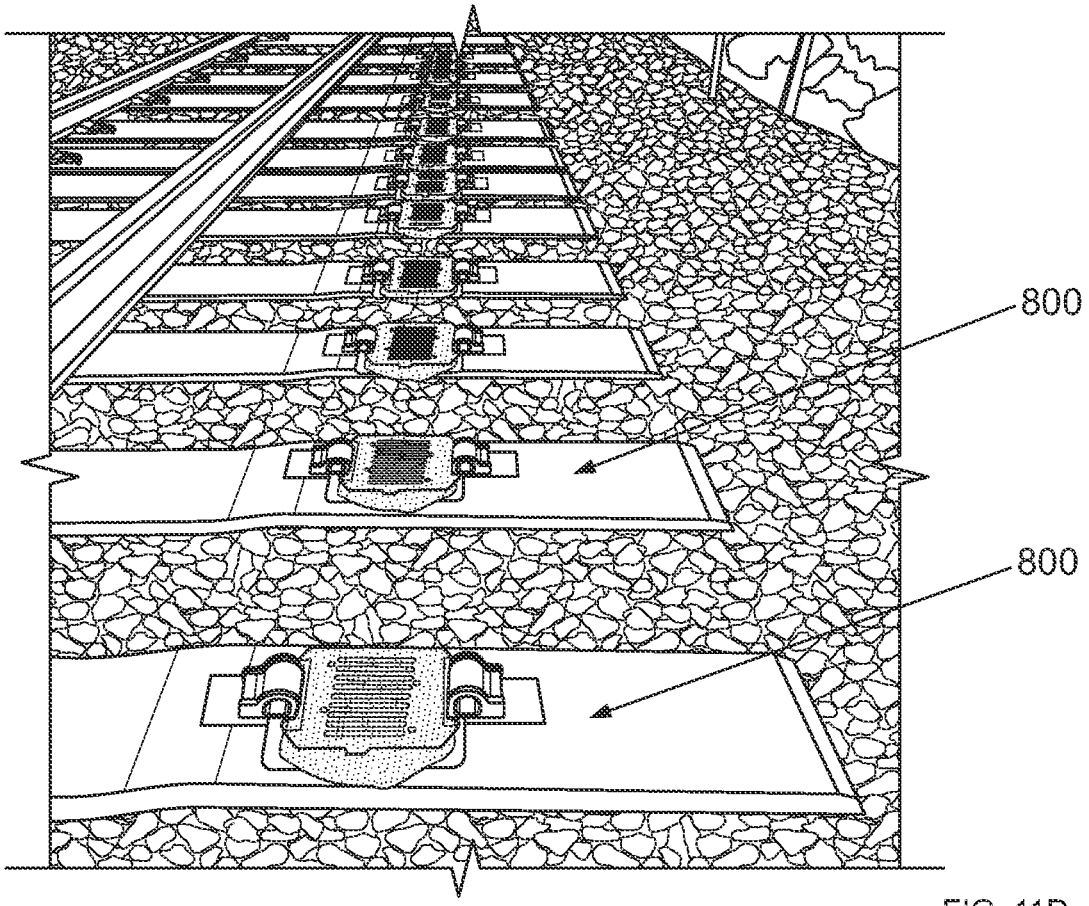
Figure 11E:
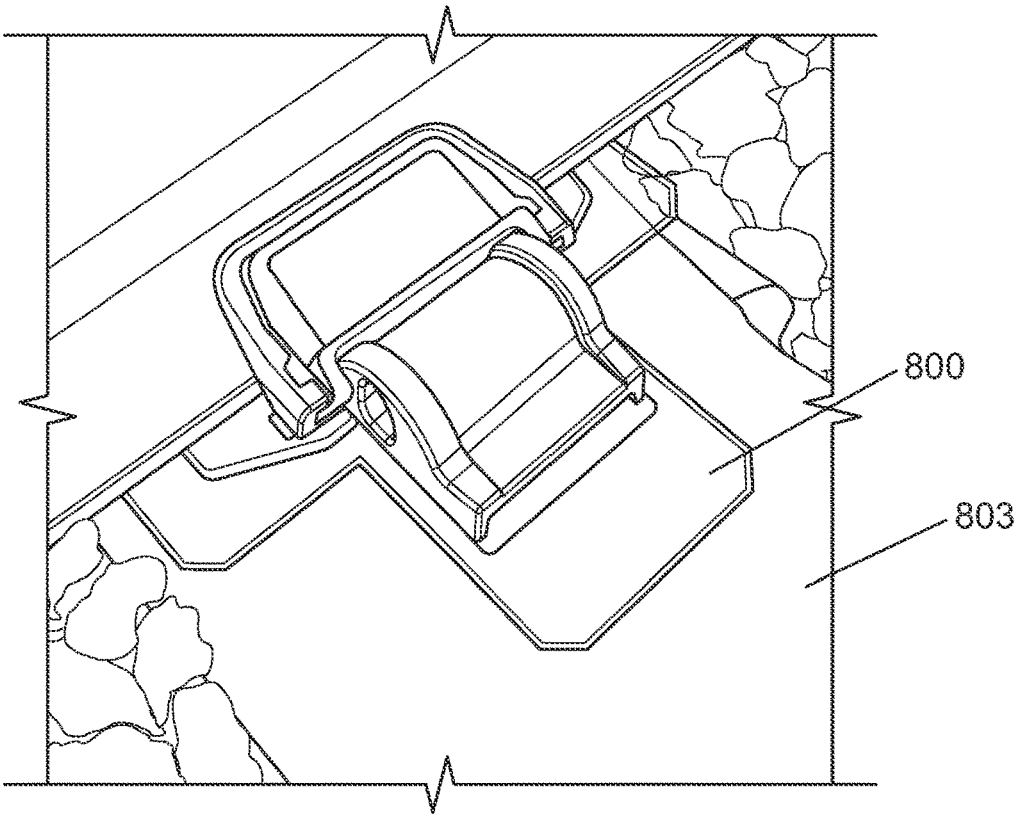
Figure 11F:
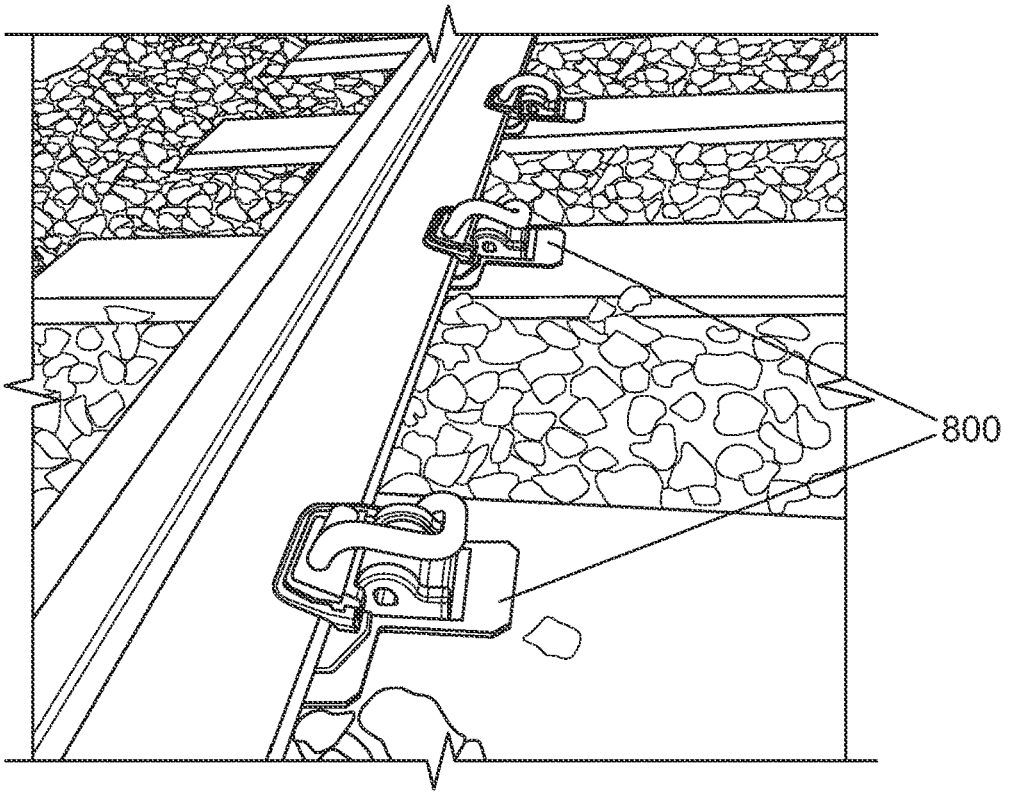

After the rail seat is cleaned, as shown in FIG. 10B, an adhesive material, such as epoxy, 815 is applied to abraded areas 809 of the rail seat on the concreate crosstie 803. The rail seat assembly 800 is then placed over the epoxy on the rail as depicted in FIG. 10C. If clips are being reused, the must be arranged in the parked position as shown. Next, in FIG. 10D, the hand tool 705 is arranged over the rail seat assembly 900 and pressure is applied to the hand tool 705 in order to adjust the rail seat to a proper height, cant and flatness. Then as shown in FIG. 10E the abraded is area 809 is visually checked to ensure the area is fully covered by repair material 815. If too little repair material 815 is applied, dial in the amount to the following crossties 803 because abrasion depth and pattern are usually similar throughout track sections. If the abraded area 809 is only on the filed side (see indication of "F" in FIG. 10C), then the repair material 815 is only needed for half of the rail seat. FIG. 1OF shows a plurality of rail seat assemblies 800 being used in track repair.

The rail seat assembly 800 provides a fully captive plastic assembly, minimizing handling of components in track as the pad, plate and field and gage insulators are fully captive and the FC need not be completely taken off, instead just pulled back into a maintenance position. The top pad minimizes risk of rail to pad interface wear. Additionally, both the abrasion plate and the insulators have dedicated features that restrain the pad from slipping and stretching (out from the rigid abrasion plate and out of the rail seat). All of the components of the rail seat assembly 800 are UV stabilized and as such, the components of the rail seat assembly 800 will not degrade to weather exposure and the transparency of the pad 802 and plate 804 will be protected.

FIGS. 11A-11F show various views of an embodiment of the transparent rail seat assembly 800 of the present disclosure being installed and final installation thereof for in-track repair of damaged rail seats.

Figure 12:
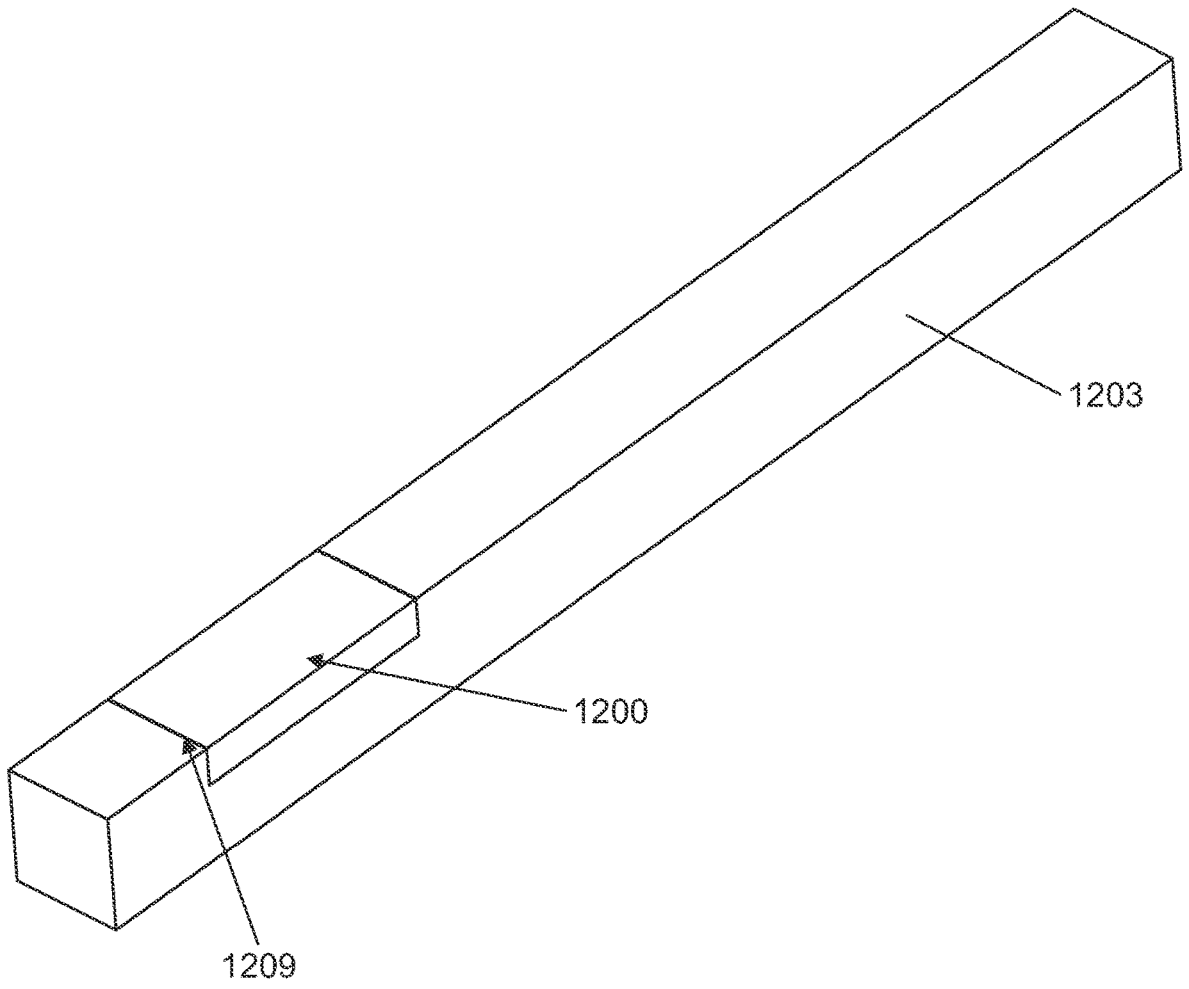
FIG. 12 shows a perspective view of a wooden crosstie on which the rail seat assembly of FIGS. 5A-5K or 8A-8G can be arranged thereon.

FIG. 12 is a perspective view of a wooden crosstie 1203 on which, after the rail seat has been cleaned, a transparent rail seat assembly 1200, such as one of those described above, is placed thereon and secured thereto by an epoxy or urethane. Then material 1209 can be injected into a "connector/hole" of the repair plate until it is filled to the top. Alternatively, tie plates can be removed and a hardening material such as an epoxy or urethane can be applied to a crosstie and the tie plate or rail seat is then reinstalled over and fixed to the epoxy or urethane. The transparent rail seat assembly ensures that the rail seat is filled evenly, flatly and fully with epoxy or urethane. The tie plate is then placed back on the assembly and the transparent rail seat assembly allows for a cut spike or screw spike to secure the tie plate to the crosstie as is customary.

The accompanying drawings illustrate embodiments of present invention and its respective constituent parts, however, other types and styles are possible, and the drawings are not intended to be limiting in that regard. Thus, although the description above and accompanying drawings contains much specificity, the details provided should not be construed as limiting the scope of the embodiment, but merely as providing illustrations of some of the features of the embodiment. The drawings and the description are not to be taken as restrictive on the scope of the embodiment and are understood as broad and general teachings in accordance with the present invention. While the present embodiment has been described using specific terms, such description is for illustrative purposes only, and it is to be understood that modifications and variations to such embodiment, including, but not limited to, the substitutions of equivalent features, materials, or parts, and the reversal of various features thereof, may be practiced by those of ordinary skill in the art without departing from the spirit and scope of the invention.

What is claimed is:

1. A rail seat assembly, comprising:

a pad that is at least one of entirely transparent and translucent and includes a main body a first rail having atop surface and a bottom surface extending both longitudinally from a first side of the main body and a uniform width from the first side of the main body to an outer periphery thereof, the first rail being devoid of one or more projections extending from the top surface thereof, and a second rail having a top surface and a bottom surface extending both longitudinally from a second side of the main body and a uniform width from the second side of the main body to an outer periphery thereof, the second rail being devoid of one or more projections extending from the top thereof with the first rail and the second rail, in an assembled state, extending over sides of a crosstie; and one of an entirely transparent and translucent plate that is independent of the pad, affixable to a top surface of the pad, and includes a plurality of grooves that are spaced from each other.

2. The rail seat assembly of claim 1, wherein the plate is releasably affixable to the pad.

3. The rail seat assembly of claim 1, wherein the plate is mounted to the pad by protrusions that extend from the pad.

4. The rail seat assembly of claim 1, further comprising insulators attached to the rail seat assembly.

5. The rail seat assembly of claim 1, further comprising a first opening extending through the pad and a second opening extending through the pad, the first opening and the second opening each being entirely encompassed within the main body of the plate.

6. The rail seat assembly of claim 1, wherein the pad includes a linearly extending top surface.

7. A method of performing in track rail assembly repair, the method comprising:

cleaning a rail seat of a crosstie;

applying an adhesive material to an abraded area of the rail seat;

placing a rail seat assembly that includes a pad that is at least one of entirely transparent and translucent and includes a main body, a first rail extending both longitudinally from a first side of the main body and a uniform width from a first side of the main body to an outer periphery thereof and a second rail extending both longitudinally from a second side of the main body and a uniform width from a second side of the main body to an outer periphery thereof, the first, rail and the second rail each having a top surface and a. bottom surface with the top surface devoid of one or more projections therefrom with the first rail and the second rail, in an assembled state, over the adhesive material;

affixing a pad that is at least one of entirely transparent and translucent, and includes a plurality of grooves that are spaced from each other to the pad; and applying pressure to the rail seat assembly to adjust the height, cant and flatness of the assembly.

8. The method of claim 7, further comprising the step of inspecting the abraded area to assess the amount of adhesive applied between the rail seat and rail seat assembly.

9. The method of claim 7, further comprising the step of ensuring a region of the rail seat assembly in contact with the rail seat and the associated rail seat is coated with adhesive material to ensure a bond therebetween that does not extend beyond the rail seat assembly.

* * * * *